US012435737B2

(12) United States Patent
Matsumura

(10) Patent No.: US 12,435,737 B2
(45) Date of Patent: Oct. 7, 2025

(54) EJECTOR AND VACUUM GENERATING DEVICE INCLUDING THE SAME

(71) Applicant: SMC CORPORATION, Tokyo (JP)

(72) Inventor: Kenichi Matsumura, Kashiwa (JP)

(73) Assignee: SMC CORPORATION, Tokyo (JP)

( * ) Notice: Subject to any disclaimer, the term of this patent is extended or adjusted under 35 U.S.C. 154(b) by 674 days.

(21) Appl. No.: 17/664,537

(22) Filed: May 23, 2022

(65) Prior Publication Data

US 2022/0403856 A1 Dec. 22, 2022

(30) Foreign Application Priority Data

Jun. 18, 2021 (JP) ..... 2021-101784

(51) Int. Cl.
*F04F 5/20* (2006.01)
*F04F 5/46* (2006.01)
*F04F 5/52* (2006.01)

(52) U.S. Cl.
CPC ..... *F04F 5/20* (2013.01); *F04F 5/463* (2013.01); *F04F 5/52* (2013.01)

(58) Field of Classification Search
CPC ..... F04F 5/20; F04F 5/463; F04F 5/52; F04F 5/14; F04F 5/18; F04F 5/16; F04F 5/44
See application file for complete search history.

(56) References Cited

U.S. PATENT DOCUMENTS 10,865,909 B2 12/2020 Yu et al.
2009/0032125 A1* 2/2009 Fukano ..... F04F 3/00 137/565.23
2019/0353279 A1 11/2019 Yu et al.
2019/0382215 A1* 12/2019 Nakayama ..... F04F 5/52
2022/0089382 A1 3/2022 Nakayama et al.

FOREIGN PATENT DOCUMENTS

JP 6-264900 A 9/1994

OTHER PUBLICATIONS

Extended European Search Report issued Dec. 22, 2022, in corresponding European Patent Application No. 22177127.2, 8 pages.
Office Action issued Oct. 29, 2024, in corresponding Japanese Patent Application No. 2021-101784 (with English Translation), 8 pages.

* cited by examiner

*Primary Examiner* — Bryan M Lettman
(74) *Attorney, Agent, or Firm* — Oblon, McClelland, Maier &Neustadt, L.L.P.

(57) ABSTRACT

An ejector includes an ejector body having an internal passage and a negative-pressure generating mechanism including a nozzle unit and a diffuser unit that generates a negative pressure by using compressed air ejected by the nozzle unit. The ejector body has a first attachment surface to which a valve body of a switching valve is attached and a second attachment surface to which a base body of the manifold base is attached. The first attachment surface has a first inflow port for supplying compressed air to the negative-pressure generating mechanism by being connected to a first output port of the switching valve, and this port communicates with the nozzle unit. The second attachment surface has a negative-pressure supply port for outputting a negative pressure to the outside by being connected to a negative-pressure inflow port of the manifold base, and this port communicates with the diffuser unit.

10 Claims, 19 Drawing Sheets

EJECTOR AND VACUUM GENERATING DEVICE INCLUDING THE SAME

TECHNICAL FIELD

The present invention relates to an ejector that generates a negative pressure by allowing pressure air to pass therethrough and a vacuum generating device that includes the ejector.

BACKGROUND ART

As disclosed in, for example, FIG. 7 of PTL 1, this type of ejector is incorporated in a vacuum generating device, such as a vacuum suction device. A vacuum suction device described in PTL 1 includes a switching valve, a vacuum generator, a suction pad, and so forth. A spool is slidably accommodated in the switching valve, and compressed air is supplied to the ejector in response to movement of the spool. In addition, the switching valve is connected to an air-supply pipe that allows compressed air discharged from a compressor or the like to flow therethrough and a supply pipe through which compressed air is supplied to the ejector.

The ejector includes a nozzle unit that ejects compressed air and a diffuser unit that mixes air which is drawn in concomitantly with the ejection of the compressed air from the nozzle unit with the compressed air and then discharges the mixed air, and the ejector is connected to the supply pipe and a vacuum pipe that is connected to the suction pad. When the pressure in the vacuum pipe becomes a negative pressure, the pressure in the suction pad also becomes a negative pressure, so that a workpiece can be sucked in and held on an end surface of the suction pad, the end surface being located on an opening side of the suction pad.

CITATION LIST

Patent Literature

PTL 1: Japanese Unexamined Patent Application Publication No. 6-264900

SUMMARY OF INVENTION

Technical Problem

In the vacuum suction apparatus described in PTL 1, however, the ejector and the switching valve are provided separately from each other, and thus, the installation space for installing both the ejector and the switching valve are large. In addition, the ejector and the switching valve need to be installed individually and connected by a pipe, which in turn increases the workload, so that an increase in the time and effort cannot be avoided.

Accordingly, it is a technical object of the present invention to provide an ejector capable of suppressing an increase in an installation space for a switching valve, the ejector, and a pipe when the switching valve, the pipe, and the like are connected to the ejector and an increase in the time and effort for the installation and a vacuum generating device that includes the ejector.

Solution to Problem

In order to solve the above problem, an ejector according to the present invention is an ejector that generates a negative pressure under an action of compressed air and includes an ejector body in which an internal passage is formed and a negative-pressure generating mechanism including a nozzle unit that is connected to the internal passage and that ejects compressed air and a diffuser unit that generates a negative pressure by using compressed air ejected by the nozzle unit and that discharges the compressed air to outside. The ejector body has a first attachment surface to which a valve body that serves as a body of a switching valve is fixedly attached and a second attachment surface to which a base body that serves as a body of the manifold base is fixedly attached. An inflow port for supplying compressed air to the negative-pressure generating mechanism by being connected to an output port that is formed in the valve body of the switching valve is formed in the first attachment surface of the ejector body, and the inflow port communicates with the nozzle unit through a positive-pressure supply passage that is included in the internal passage in the ejector body. A negative-pressure supply port for outputting a negative pressure, which is generated in the negative-pressure generating mechanism, to outside by being connected to a negative-pressure inflow port that is formed in the base body of the manifold base is formed in the second attachment surface of the ejector body, and the negative-pressure supply port communicates with the diffuser unit through a negative-pressure communication passage that is included in the internal passage in the ejector body.

In this case, it is preferable that an ejector-side air-supply port for supplying compressed air to the switching valve by being connected to a switching-valve-side air-supply inflow port that is formed in the valve body of the switching valve be formed in the first attachment surface and that an air supply inflow port for causing compressed air to flow into by being connected to an air-supply port that is formed in the base body of the manifold base is formed in the second attachment surface. It is preferable that the ejector-side air supply port and the air-supply inflow port communicate with each other through an air-supply communication passage that is included in the internal passage in the ejector body.

In addition, it is preferable that the inflow port of the first attachment surface include a first inflow port and a second inflow port that are respectively connected to a first output port and a second output port that are formed in the valve body of the switching valve and that one of the first inflow port and the second inflow port communicate with the nozzle unit through the internal passage. It is preferable that another one of the first inflow port and the second inflow port communicate with the negative-pressure supply port through the internal passage.

In addition, it is preferable that the negative-pressure supply port include a first negative-pressure supply port and a second negative-pressure supply port for supplying a negative pressure by being respectively connected to a first negative-pressure inflow port and a second negative-pressure inflow port that are formed in the base body of the manifold base and that the first negative-pressure supply port and the second negative-pressure supply port communicate with the diffuser unit through the negative-pressure communication passage included in the internal passage. It is preferable that the other one of the first inflow port and the second inflow port communicates with the negative-pressure communication passage through an inflow communication passage that is included in the internal passage.

In addition, it is preferable that a throttle unit for controlling a flow rate of air that flows toward the negative-pressure supply port be disposed in the inflow communication passage. It is further preferable that a check valve that allows a flow of air from the negative-pressure communication passage toward the diffuser unit and limits a flow of air from the diffuser unit toward the negative-pressure communication passage be disposed in the negative-pressure communication passage. It is further preferable that a discharge port for discharging compressed air discharged by the diffuser unit is disposed downstream from the diffuser unit.

A vacuum generating device according to the present invention is a vacuum generating device including the ejector, the manifold base attached to the second attachment surface of the ejector, and the switching valve attached to the first attachment surface of the ejector. The switching valve includes the valve body having a valve hole that is formed in such a manner as to extend from a first end side to a second end side in an axial direction and a plurality of ports that are formed in such a manner as to communicate with the valve hole, a spool that is accommodated in the valve hole of the valve body in such a manner as to be capable of freely sliding in the axial direction, a first driving unit and a second driving unit that are arranged at two ends of the spool in the axial direction and that move the spool to a second-end-side switching position on the second end side in the axial direction and move the spool to a first-end-side switching position on the first end side in the axial direction, and a spool moving mechanism unit that selectively moves the spool to a first-intermediate switching position and a second-intermediate switching position that are located between the first-end-side switching position and the second-end-side switching position and that are different from each other. The plurality of ports includes the first output port connected to the first inflow port of the ejector, the second output port connected to the second inflow port of the ejector, and the switching-valve-side air-supply inflow port to which compressed air is supplied by being connected to the ejector-side air-supply port formed in the first attachment surface of the ejector. The spool moving mechanism unit moves the spool that has moved to the first-end-side switching position to the first-intermediate switching position when the spool is released from being pressed by the second driving unit and moves the spool that has moved to the second-intermediate switching position to the second-intermediate switching position when the spool is released from being pressed by the first driving unit. The first-intermediate switching position is in a communication state in which one of the first output port and the second output port that is in communication with the nozzle unit communicates with the switching-valve-side air-supply inflow port and in which the other ports are closed and do not communicate with each other. The second-intermediate switching position is in a non-communication state in which all the plurality of ports are closed and do not communicate with each other.

In this case, the spool includes a spring seat shaft that is coaxial with the spool. The spool moving mechanism unit includes a first spring seat and a second spring seat that are respectively arranged on a first end side and a second end side of the spring seat shaft in the axial direction in such a manner as to be freely movable in the axial direction and includes a compression spring that is provided between the first spring seat and the second spring seat. The spring seat shaft includes a pair of contact portions arranged at the two ends of the spring seat shaft in the axial direction such that the first and second spring seats are brought into contact with the contact portions, and the compression spring is disposed so as to be compressed when the first and second spring seats are in contact with the pair of contact portions. A pair of stopper portions with which the first and second spring seats are brought into contact are provided at two sides of the valve hole of the valve body in the axial direction with the spool moving mechanism unit interposed between the stopper portions. When a length between the pair of contact portions in the axial direction is X, a length between the pair of stopper portions in the axial direction is Y, a stroke length of the spool by the first driving unit is S1, and a stroke length of the spool by the second driving unit is S2, relationships of $X<Y$ and $Y-X<S1$, S2 are satisfied.

In addition, it is preferable that the valve hole have a spring accommodating chamber that extends in the axial direction and in which the spool moving mechanism unit is accommodated and that the spring accommodating chamber have a pair of end walls that are formed at two ends of the spring accommodating chamber in the axial direction and each of which extends outward in a radial direction. It is preferable that one of the pair of end walls include the stopper portion with which the first spring seat is brought into contact and that another one of the pair of end walls include the stopper portion with which the second spring seat is brought into contact. Furthermore, it is preferable that the pair of contact portions include a first step portion that projects outward in the radial direction from the first end of the spring seat shaft in the axial direction and that is capable of coming into contact with the first spring seat and a second step portion that projects outward in the radial direction from the second end of the spring seat shaft in the axial direction and that is capable of coming into contact with the second spring seat, and it is preferable that the spool be switched to the first-intermediate switching position in a state where the first spring seat is in contact with the end wall on a first side of the spring accommodating chamber in the axial direction and the first step portion and where the second spring seat is in contact with the second spring seat and be switched to the second-intermediate switching position in a state where the second spring seat is in contact with the end wall on a second side of the spring accommodating chamber in the axial direction and the second spring seat and where the first spring seat is in contact with the first step portion.

Advantageous Effects of Invention

As described above, according to the present invention, an ejector that is capable of suppressing an increase in an installation space for a switching valve, the ejector, and a pipe when the switching valve, the pipe, and so forth are connected to the ejector and an increase in the time and effort for the installation and a vacuum generating device that includes the ejector can be provided.

DESCRIPTION OF EMBODIMENTS

An ejector according to the present invention and a vacuum generating device according to the present invention that includes the ejector will be described below. Note that, in the present embodiment, the ejector forms part of the vacuum generating device, and thus, the ejector will be described in the description of the vacuum generating device.

First Embodiment

Figure 1:
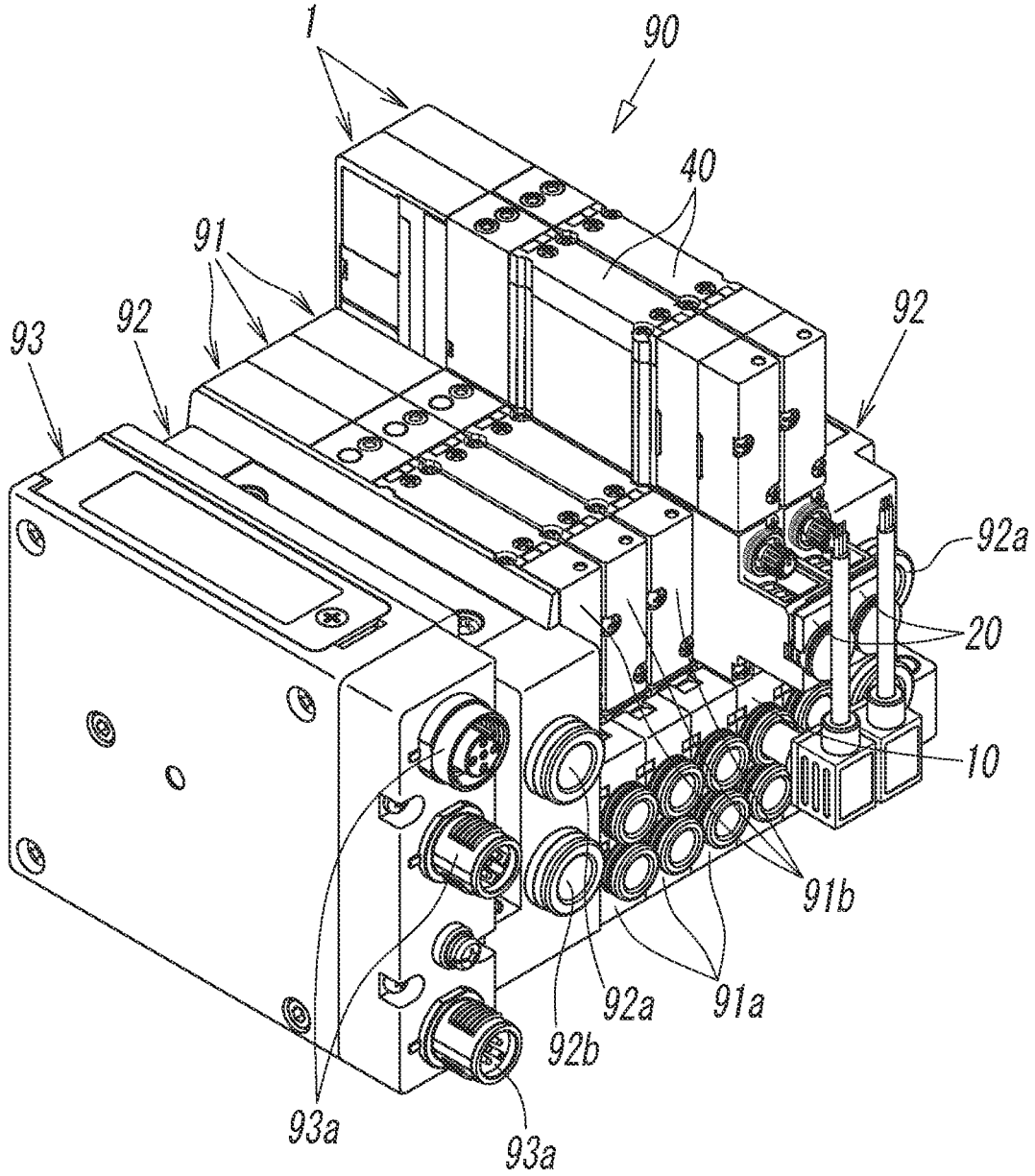
FIG. 1 is an external perspective view of a continuous assembly that includes a vacuum generating device according to a first embodiment of the present invention.

FIG. 1 illustrates a continuous assembly 90 that includes vacuum generating devices 1, switching-valve blocks 91, port blocks 92, and an end block 93 that are arranged in a width direction, which is perpendicular to the vertical direction, and integrated with one another. As illustrated in FIG. 1, these units included in the continuous assembly 90 are connected together with tie rods or the like (not illustrated) by bringing their side surfaces that are oriented in the width direction into contact with each other so that these units are capable of coming into and out of contact with each other. Each of the switching-valve blocks 91 includes a manifold base 91*a* and a switching valve 91*b* that is mounted on the manifold base 91*a*, and each of the port blocks 92 has a supply port 92*a* and a discharge port 92*b* that are provided on the front surface side thereof. The end block 93 includes a plurality of connectors 93*a* that are provided on the front surface side thereof and supplies electrical power and electric signals to solenoids that are provided in the switching valve 91*b* of each of the switching-valve blocks 91 and a switching valve 40 of each of the vacuum generating devices 1.

Figure 2:
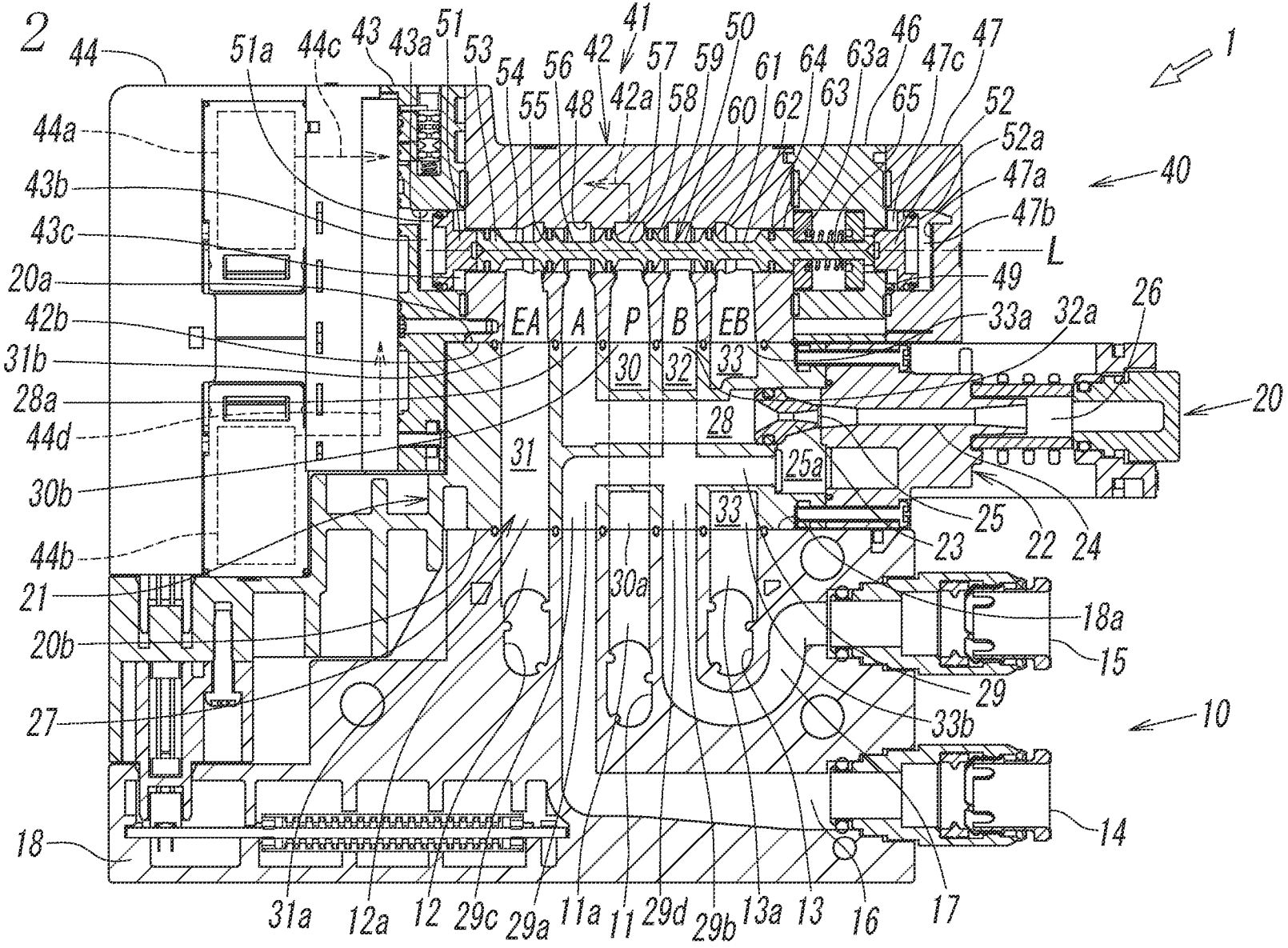
FIG. 2 is a sectional view of the vacuum generating device according to the first embodiment that includes a three-position switching valve.

As illustrated in FIG. 1 and FIG. 2, each of the vacuum generating devices 1 includes a manifold base 10, an ejector 20 that is mounted on the manifold base 10, and the switching valve 40 that is mounted on the ejector 20. The manifold base 10 includes a base body 18 that serves as a body of the manifold base 10, and the base body 18 is a commonly known base body that has an air-supply hole 11, a first discharge hole 12, a second discharge hole 13, a first negative-pressure port 14, and a second negative-pressure port 15. In the present embodiment, the base body 18 is formed in a rectangular parallelepiped shape extending in a longitudinal direction that is perpendicular to the width direction and has a front surface on which the first negative-pressure port 14 and the second negative-pressure port 15 are formed so as to project therefrom. A rear end portion of the first negative-pressure port 14 and a rear end portion of the second negative-pressure port 15 respectively communicate with a first negative-pressure passage 16 and a second negative-pressure passage 17 that are formed in the base body 18, and these negative-pressure passages 16 and 17 are curved and extend upward in such a manner as to be open to an upper end surface 18*a* of the base body 18 (hereinafter referred to as a "first negative-pressure inflow port 16*a*" and a "second negative-pressure inflow port 17*a*") (see FIG. 3).

In an upper portion of the base body 18, the first discharge hole 12, the air-supply hole 11, and the second discharge hole 13 are formed in this order from the rear side to the front side in such a manner as to be spaced apart from one another, and all the first discharge hole 12, the air-supply hole 11, and the second discharge hole 13 extend between the two side surfaces of the base body 18. The air-supply hole 11 communicates with the supply port 92*a* of a corresponding one of the port blocks 92 (see FIG. 1), and the first discharge hole 12 and the second discharge hole 13 communicate with the discharge port 92*b* of the port block 92. The air-supply hole 11 communicates with an air-supply passage 11*a* that branches off therefrom so as to extend upward, and an upper end portion of the air-supply passage 11*a* is open to the upper end surface 18*a* of the base body 18 (hereinafter referred to as an "air-supply port 11*b*").

Figure 3:
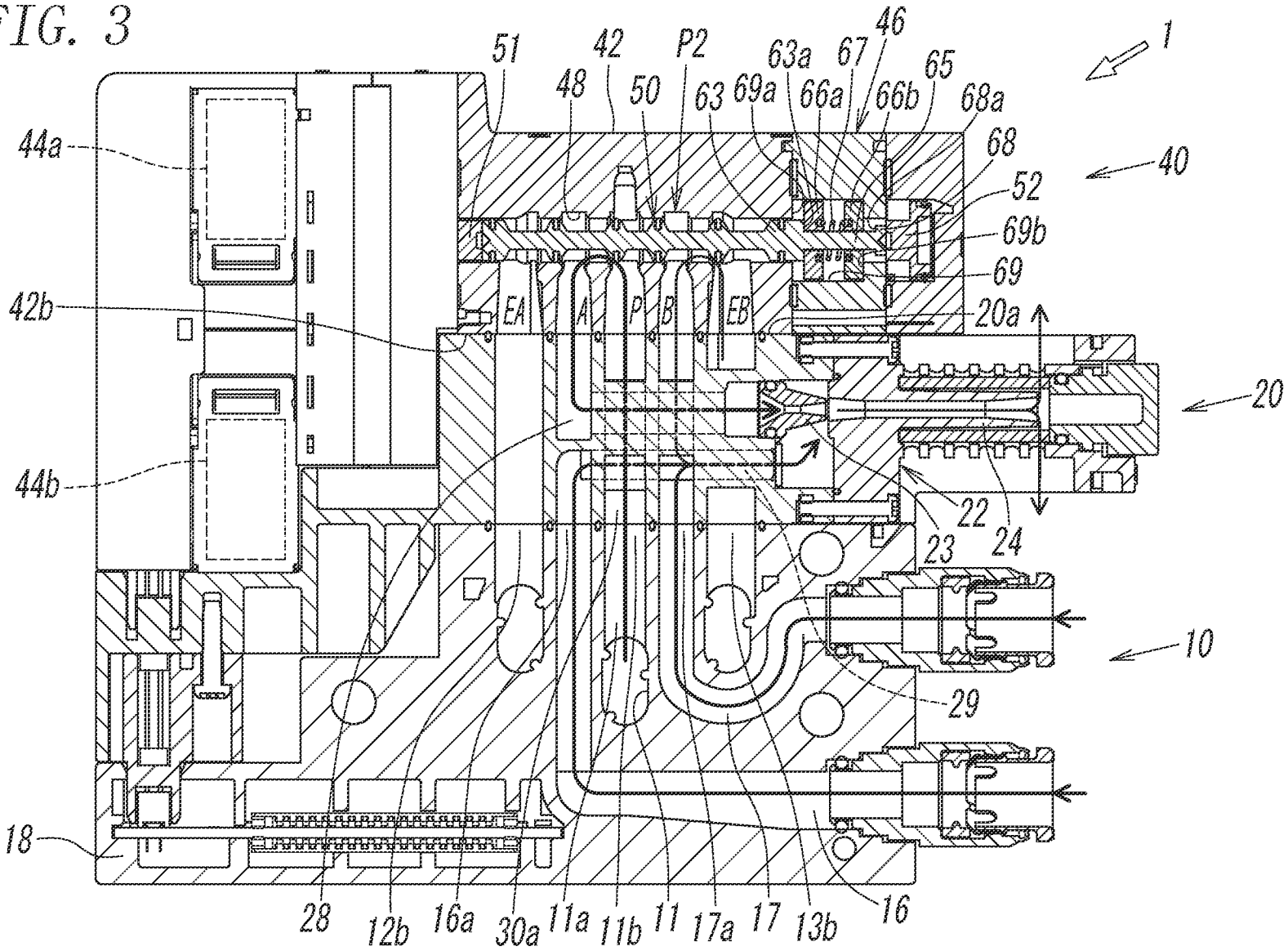
FIG. 3 is a diagram illustrating an operation of the vacuum generating device according to the first embodiment when it performs a negative-pressure operation.

The first discharge hole 12 communicates with a first discharge branch passage 12*a* that branches off therefrom so as to extend upward, and the second discharge hole 13 communicates with a second discharge branch passage 13*a* that branches off therefrom so as to extend upward. An upper end portion of the first discharge branch passage 12*a* is open at a position further toward the rear side than the position at which the first negative-pressure passage 16 is open to the upper end surface 18*a* (hereinafter referred to as a "first discharge inflow port 12*b*") (see FIG. 3), and an upper end portion of the second discharge branch passage 13*a* is open at a position further toward the front side than the position at which the second negative-pressure passage 17 is open to the upper end surface 18*a* (hereinafter referred to as a "second discharge inflow port 13*b*") (see FIG. 3). In addition, the air-supply port 11*b* of the air-supply passage 11*a* is open at a position between the position at which the first negative-pressure passage 16 is open and the position at which the second negative-pressure passage 17 is open in the upper end surface 18*a*. In other words, as illustrated in FIG. 3, the port 12*b* of the first discharge branch passage 12*a*, the port 16*a* of the first negative-pressure passage 16, the port 11*b* of the air-supply passage 11*a*, the port 17*a* of the second negative-pressure passage 17, and the port 13*b* of the second discharge branch passage 13*a* are open to the upper end surface 18*a* of the base body 18 in this order from the rear side to the front side.

The upper end surface 18*a* of the base body 18 is formed in a planar rectangular shape extending in the longitudinal direction and is brought into contact with and fixedly attached to a second attachment surface 20*b* of the ejector 20, which will be described later.

One of the switching valves 40 will now be described. As illustrated in FIG. 2, the switching valve 40 is a commonly known pilot-operated three-position switching valve and has a configuration for functioning as a five-port valve. The switching valve 40 includes a valve body 41 that extends in an L-axis direction (the longitudinal direction) and serves as a body of the switching valve 40. The valve body 41 includes a main body 42 that has five ports EA, A, P, B, and EB arranged in this order from a first end side in the L-axis direction (the rear side) to a second end side in the L-axis direction (the front side), a first piston cover 43, a pilot valve unit 44, a spring cover 46, and a second piston cover 47. The first piston cover 43 and the pilot valve unit 44 are connected in series to the rear end of the main body 42, and the spring cover 46 and the second piston cover 47 are connected in series to the front end of the main body 42.

The five ports EA, A, P, B, and EB are the switching-valve-side air-supply inflow port P that is positioned in the middle among these five ports in the L-axis direction, a first output port A (an output port) that is positioned on one side of the switching-valve-side air-supply inflow port P, a second output port B (an output port) that is positioned on the other side of the switching-valve-side air-supply inflow port P, a first discharge port EA that is positioned so as to be closer to the first piston cover 43 than the first output port A is, and a second discharge port EB that is positioned so as to be closer to the second piston cover 47 than the second output port B is.

A valve hole 48 having a circular cross section extends through the main body 42 and the spring cover 46 in the L-axis direction and communicate with the five ports EA, A, P, B, and EB. A spool 50 is inserted in the valve hole 48 in such a manner as to be capable of freely sliding in the L-axis direction of the valve hole 48. The spool 50 is formed so as to have a length that is slightly shorter than that of the valve hole 48 in the L-axis direction, and a first piston 51 and a second piston 52 are respectively accommodated in a piston chamber 43*a* and a piston chamber 47*a* in such a manner as to be capable of freely sliding and are arranged so as to come into and out of contact with first and second ends of the spool 50 in the L-axis direction, respectively.

Figure 4:
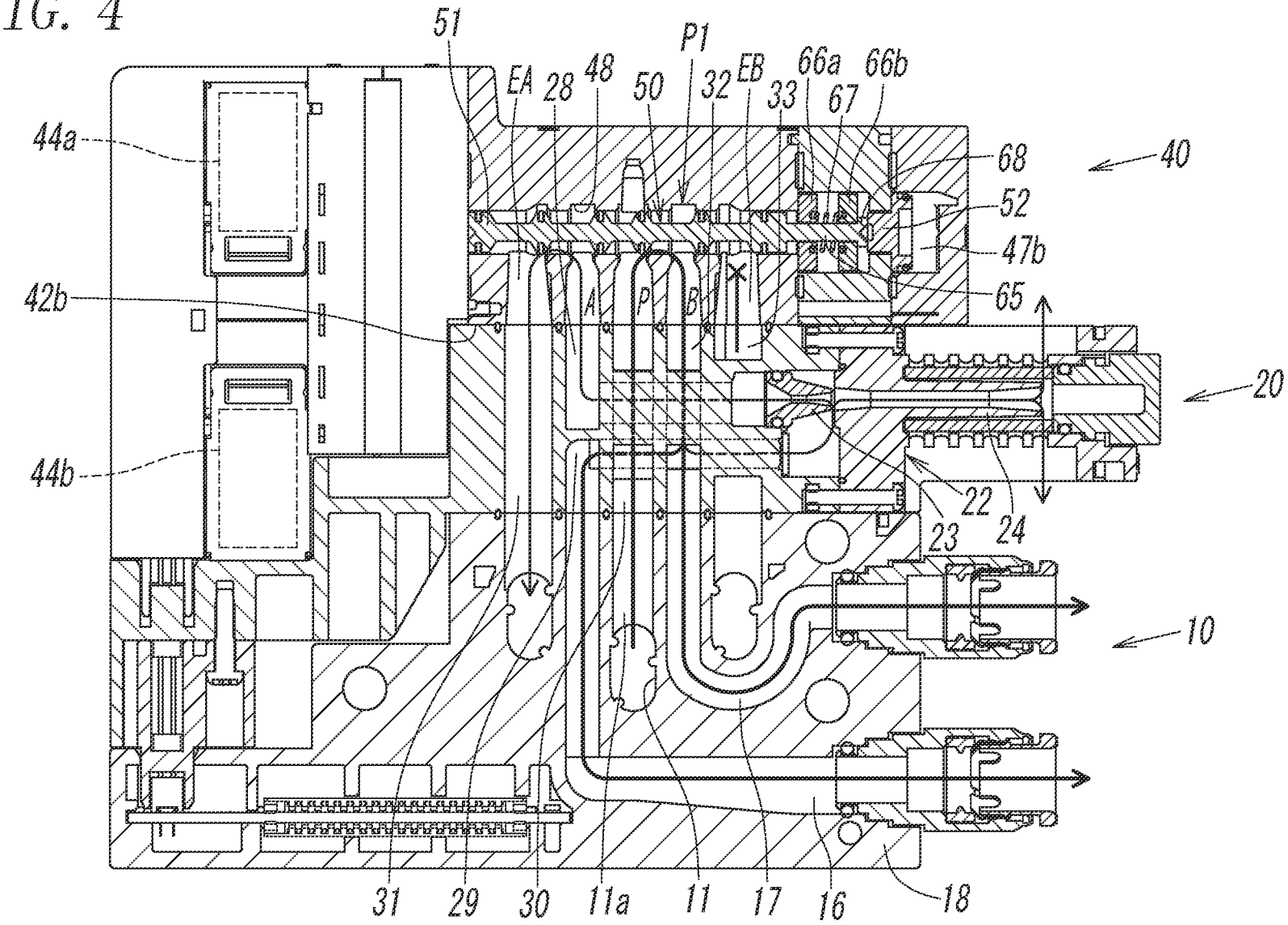
FIG. 4 is a diagram illustrating an operation of the vacuum generating device according to the first embodiment when it breaks a vacuum (when it supplies a positive pressure).

The first piston 51 and the second piston 52 switch the spool 50 between a second-end-side switching position P2 illustrated in FIG. 3 and a first-end-side switching position P1 illustrated in FIG. 4 through the action of a pilot air pressure. The first piston 51 and the second piston 52 have the same shape, and a pressure receiving surface 51*a* of the first piston 51 and a pressure receiving surface 52*a* of the second piston 52 respectively face a first pilot chamber 43*b* and a second pilot chamber 47*b*. The first pilot chamber 43*b* and the second pilot chamber 47*b* have the same shape.

The pilot valve unit 44 includes a first pilot valve 44*a* and a second pilot valve 44*b*. In the present embodiment, the first pilot valve 44*a* and the second pilot valve 44*b* are arranged so as to be located further toward the rear side than the first piston cover 43, and in the vertical direction, which is perpendicular to the L-axis direction, the first pilot valve 44*a* and the second pilot valve 44*b* are positioned on the upper side and the lower side, respectively.

The first pilot valve 44*a* is connected to the first pilot chamber 43*b* via a first pilot output passage 44*c*, and the second pilot valve 44*b* is connected to the second pilot chamber 47*b* via a second pilot output passage 44*d*. Both the pilot valves 44*a* and 44*b* are connected to the switching-valve-side air-supply inflow port P via a pilot supply passage 42*a*. The first and second pilot output passages 44*c* and 44*d* and the pilot supply passage 42*a* are formed in the valve body 41.

In addition, a rear surface chamber 43*c* that faces the rear surface of the first piston 51 and a rear surface chamber 47*c* that faces the rear surface of the second piston 52 are open to the atmosphere through an open path 49.

As illustrated in FIG. 2, in the spool 50, a first airtight portion 53 that is airtightly fitted to the rear side of the valve hole 48 so as to be capable of freely sliding, a first annular recess 54, a first land portion 55, a second annular recess 56, a second land portion 57, a third annular recess 58, a third land portion 59, a fourth annular recess 60, a fourth land portion 61, a fifth annular recess 62, and a second airtight portion 63 that is airtightly fitted to the front side of the valve hole 48 so as to be capable of freely sliding are arranged in this order from the rear side to the front side in the L-axis direction, and each of these is formed in a columnar shape around the axis L. In other words, in the spool 50, the annular recesses 54, 56, 58, 60, and 62 and the land portions 55, 57, 59, and 61 serving as valve portions are alternately formed along the L-axis direction.

Packing members 64 are fitted to outer sliding surfaces of the airtight portions 53 and 63 and outer sliding surfaces of the land portions 55, 57, 59, and 61 in their radial direction, and these packing members 64 open and close passages each of which is formed between adjacent ones of the ports EA, A, P, B, and EB. An annular first step portion 63*a* that extends outward in the radial direction is formed at the front end of the second airtight portion 63.

As illustrated in FIG. 2 and FIG. 3, in the switching valve 40 having the above configuration, when the first pilot valve 44*a* is switched on such that compressed air is supplied as a pilot fluid to the first pilot chamber 43*b* from the switching-valve-side air-supply inflow port P and the second pilot valve 44*b* is switched off such that the second pilot chamber 47*b* is open to the atmosphere, the first piston 51 is pushed toward the second piston 52 by the pilot fluid pressure, and thus, as illustrated in FIG. 3, the spool 50 moves in the valve hole 48 toward the second piston 52 and is switched to the second-end-side switching position P2.

In addition, as illustrated in FIG. 4, when the second pilot valve 44*b* is switched on such that the compressed air is supplied as the pilot fluid to the second pilot chamber 47*b* from the switching-valve-side air-supply inflow port P and the first pilot valve 44*a* is switched off such that the first pilot chamber 43*b* is open to the atmosphere, the second piston 52 is pushed toward the first piston 51 by the pilot fluid pressure, and thus, the spool 50 moves in the valve hole 48 toward the first piston 51 and is switched to the first-end-side switching position P1.

At the second end of the spool 50 in the L-axis direction (hereinafter referred to as the "front end"), as illustrated in FIG. 3, a spring seat shaft 65 extends in the L-axis direction (see FIG. 2), and a first spring seat 66*a* and a second spring seat 66*b* are arranged on the spring seat shaft 65 so as to be freely movable in the longitudinal direction. A compression spring 67 is provided between the first spring seat 66*a* and the second spring seat 66*b*, and the compression spring 67 is inserted, in a state of being compressed, between the first spring seat 66*a* and the second spring seat 66*b*. A to-be-pressed portion 68 that extends frontward is formed at the front end of the spring seat shaft 65, and the to-be-pressed portion 68 has a columnar shape that extends coaxially with the spool 50 and has a diameter larger than that of the spring seat shaft 65 and smaller than the inner diameter of the valve hole 48. An annular second step portion 68*a* is formed at the rear end portion of the to-be-pressed portion 68 in such a manner as to face rearward.

In the spring cover 46, a spring accommodating chamber 69 is formed so as to extend in the L-axis direction and so as to surround the first spring seat 66*a*, the second spring seat 66*b*, and the compression spring 67. The spring accommodating chamber 69 has a circular cross section and has a diameter larger than the inner diameter of the valve hole 48, and the spring accommodating chamber 69 extends forward from the rear end of the spring cover 46. An annular end wall 69*a* is formed at the rear end of the spring accommodating chamber 69 in such a manner as to extend from the inner side toward the outer side in the radial direction, and an annular end wall 69*b* is formed at the front end of the spring accommodating chamber 69 in such a manner as to extend from the inner side toward the outer side in the radial direction.

Figure 5:
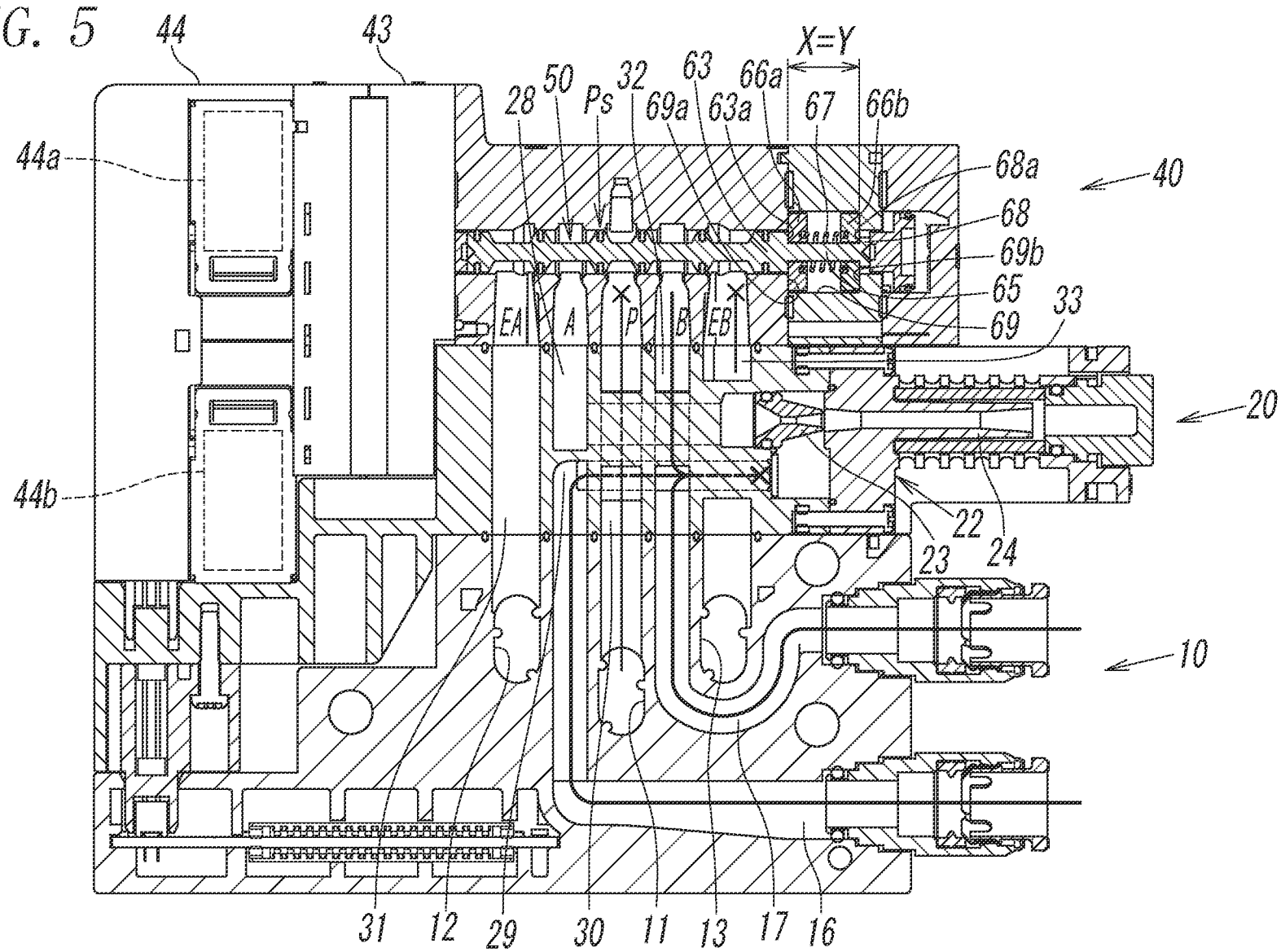
FIG. 5 is a diagram illustrating an operation of the vacuum generating device according to the first embodiment when it maintains a vacuum state.

As illustrated in FIG. 5, the first spring seat 66*a* and the second spring seat 66*b* are urged by the compression spring 67 such that the first spring seat 66*a* is brought into contact with the first step portion 63*a* and the second spring seat 66*b* is brought into contact with the second step portion 68*a*. Here, a length Y between the end walls 69*a* and 69*b* on the two sides of the spring accommodating chamber 69 in the longitudinal direction is the same as a length X of the spool 50 between the first step portion 63*a* and the second step portion 68*a*. Thus, in a state where the first spring seat 66*a* and the second spring seat 66*b* are in contact with the first step portion 63*a* and the second step portion 68*a*, respectively, the first spring seat 66*a* is further in contact with the end wall 69*a* on the rear side of the spring accommodating chamber, and the second spring seat 66*b* is further in contact with the end wall 69*b* on the front side of the spring accommodating chamber 69.

In the present embodiment, in a state where the first spring seat 66*a* is in contact with the first step portion 63*a* of the second airtight portion 63 and the end wall 69*a* on the rear side of the spring accommodating chamber 69 and where the second spring seat 66*b* is in contact with the second step portion 68*a* of the to-be-pressed portion 68 and the end wall 69*b* on the front side of the spring accommodating chamber 69, the spool 50 moves to a neutral switching position Ps. When the spool 50 is switched to the neutral switching position Ps, the switching valve 40 is brought into a non-communication state in which all the ports EA, A, P, B, and EB are closed.

In addition, as illustrated in FIG. 4, when the spool 50 is switched to the first-end-side switching position P1, the switching valve 40 is brought into a first communication state in which the switching-valve-side air-supply inflow port P and the first output port A respectively communicate with the second output port B and the first discharge port EA and in which the second discharge port EB is closed. Furthermore, as illustrated in FIG. 3, when the spool 50 is switched to the second-end-side switching position P2, the switching valve 40 is brought into the second communication state in which the switching-valve-side air-supply inflow port P and the second output port B respectively communicate with the first output port A and the second discharge port EB and in which the first discharge port EA is closed.

A lower end surface 42*b* to which the five ports EA, A, P, B, and EB are open is formed at the lower end of the main body 42 of the switching valve 40. The lower end surface 42*b* is formed in a planar rectangular shape extending in the longitudinal direction. The lower end surface 42*b* is positioned so as to face a first attachment surface 20*a* of the corresponding ejector 20, which will be described later, and fixedly attached to the first attachment surface 20*a*.

One of the ejectors 20 will now be described. As illustrated in FIG. 2, the ejector 20 includes an ejector body 21 in which an internal passage 27 is formed. The ejector body 21 is formed in a rectangular parallelepiped shape extending in the longitudinal direction. The ejector body 21 has the first attachment surface 20*a* to which the valve body 41 of the corresponding switching valve 40 is fixedly attached and the second attachment surface 20*b* to which the base body 18 of the corresponding manifold base 10 is fixedly attached.

The first attachment surface 20*a* is formed at the upper end of the ejector body 21 so as to have a planar shape extending in the longitudinal direction, and in the present embodiment, the first attachment surface 20*a* is formed in a rectangular shape extending in the longitudinal direction. In contrast, the second attachment surface 20*b* is formed at the lower end of the ejector body 21 so as to have a planar shape extending in the longitudinal direction, and in the present embodiment, the second attachment surface 20*b* is formed in a rectangular shape extending in the longitudinal direction. The first attachment surface 20*a* and the second attachment surface 20*b* extend parallel to each other.

The ejector body 21 has a negative-pressure generating mechanism 22 that generates a negative pressure under the action of a compressed air, a discharge port 26 that discharges the compressed air that has passed through the negative-pressure generating mechanism 22, and the internal passage 27 that is formed in the ejector 20 and that allows communication between the corresponding manifold base 10 and the corresponding switching valve 40.

The negative-pressure generating mechanism 22 is detachably disposed on the front side in the ejector body 21, and the discharge port 26 that discharges the compressed air discharged from a diffuser unit 24 is provided at the front end portion of the ejector body 21. The negative pressure generated by the ejector 20 is supplied to a vacuum device (not illustrated) through the first and second negative-pressure passages 16 and 17 and the first and second negative-pressure ports 14 and 15 of the manifold base 10.

The negative-pressure generating mechanism 22 includes a nozzle unit 23 and the diffuser unit 24. The nozzle unit 23 extends in the longitudinal direction (the L-axis direction) and ejects the compressed air supplied thereto. The diffuser unit 24 is disposed downstream from the nozzle unit 23 so as to be coaxial with the nozzle unit 23, and the diffuser unit 24 mixes air which is drawn in concomitantly with the ejection of the compressed air from the nozzle unit 23 with the compressed air and then discharges the mixed air. A supply passage 28 (a positive-pressure supply passage) is connected to the rear end portion of the nozzle unit 23, and the supply passage 28 extends rearward from the nozzle unit 23 and is curved upward so as to be open to the first attachment surface 20*a* of the ejector 20 (hereinafter referred to as a "first inflow port 28*a*"), so that the supply passage 28 guides the compressed air to an entrance to the nozzle unit 23. The nozzle unit 23 is formed in a cylindrical shape, and the inner diameter of an intermediate portion of the nozzle unit 23 in the longitudinal direction is reduced. The diffuser unit 24 is positioned on the downstream side (the front side) of the nozzle unit 23.

The diffuser unit 24 is formed in a cylindrical shape that extends in the longitudinal direction and that is longer than the nozzle unit 23. The nozzle unit 23 and the diffuser unit 24 are arranged with a predetermined gap 25 formed therebetween. The discharge port 26 is positioned on the downstream side (the front side) of the diffuser unit 24 and configured to discharge discharged air outward in the radial direction.

The gap 25 between the nozzle unit 23 and the diffuser unit 24 communicates with a communication space 25*a* that is formed below the nozzle unit 23, and the communication space 25*a* communicates with a negative-pressure communication passage 29 that is formed in a lower portion of the ejector 20. In the present embodiment, the negative-pressure communication passage 29 extends in the longitudinal direction and has two negative-pressure communication branch passages, which are a first negative-pressure communication branch passage 29*a* and a second negative-pressure communication branch passage 29*b* and each of which branches off from an intermediate portion of the negative-pressure communication passage 29 in the longitudinal direction. An end of the first negative-pressure communication branch passage 29*a* is open to the second attachment surface 20*b* of the ejector 20 (hereinafter referred to as a "first negative-pressure supply port 29*c*"), and an end of the second negative-pressure communication branch passage 29*b* is open at a position further toward the front side than the end of the first negative-pressure supply port 29*c* in the second attachment surface 20*b* (hereinafter referred to as a "second negative-pressure supply port 29*d*"). The first negative-pressure communication branch passage 29*a* communicates with the first negative-pressure passage 16 through the first negative-pressure inflow port 16*a* of the corresponding manifold base 10, and the second negative-pressure communication branch passage 29*b* communicates with the second negative-pressure passage 17 through the second negative-pressure inflow port 17*a* of the manifold base 10.

In the ejector body 21, an air-supply communication passage 30 that communicates with the air-supply passage 11*a* of the corresponding manifold base 10 is formed. In the present embodiment, the air-supply communication passage 30 extends in the vertical direction in the ejector body 21, and the lower end of the air-supply communication passage 30 is open to the second attachment surface 20*b* of the ejector 20 (hereinafter referred to as an "air-supply inflow port 30*a*"). The air-supply inflow port 30*a* is located between the first negative-pressure supply port 29*c* in the first negative-pressure communication branch passage 29*a* and the second negative-pressure supply port 29*d* in the second negative-pressure communication branch passage 29*b*.

In contrast, the upper end of the air-supply communication passage 30 is open at a position further toward the front side than the opening at the upper end of the supply passage 28 (the first inflow port 28*a*) (hereinafter referred to as an "ejector-side air-supply port 30*b*"). In other words, the air-supply inflow port 30*a* and the ejector-side air-supply port 30*b* communicate with each other through the air-supply communication passage 30.

A first discharge communication passage 31 is formed at a position further toward the rear side than the supply passage 28 and the first negative-pressure communication branch passage 29*a* so as to extend in the vertical direction. The lower end of the first discharge communication passage 31 is open to the second attachment surface 20*b* of the ejector 20 (hereinafter referred to as a "first discharge outflow port 31*a*") and communicates with the first discharge branch passage 12*a* through the first discharge inflow port 12*b* of the corresponding manifold base 10. The upper end of the first discharge communication passage 31 is open to the first attachment surface 20*a* of the ejector 20 (hereinafter referred to as a "first discharge inflow port 31*b*") and is connected to the first discharge port EA of the corresponding switching valve 40.

A second inflow communication passage 32 is provided at a position further toward the front side than the air-supply communication passage 30. The upper end of the second inflow communication passage 32 is open to the first attachment surface 20*a* of the ejector 20 (hereinafter referred to as a "second inflow port 32*a*"). In addition, the lower end of the second inflow communication passage 32 communicates with the negative-pressure communication passage 29.

In addition, a second discharge communication passage 33 is provided at a position further toward the front side than the second inflow communication passage 32. The upper end of the second discharge communication passage 33 is open to the first attachment surface 20*a* of the ejector 20 (hereinafter referred to as a "second discharge inflow port 33*a*"), and the lower end of the second discharge communication passage 33 is open to the second attachment surface 20*b* of the ejector 20 (hereinafter referred to as a "second outflow port 33*b*"). In the present embodiment, one side of the second discharge communication passage 33 that is closer to the corresponding switching valve 40 is closed above the supply passage 28 of the ejector 20, and the other side of the second discharge communication passage 33 that is closer to the corresponding manifold base 10 is closed below the negative-pressure communication passage 29 of the ejector 20. In other words, the second discharge communication passage 33 is in a non-communication state in which it is closed at a position partway therealong.

In other words, in the ejector body 21, the internal passage 27 that includes the first discharge communication passage 31, the supply passage 28, the negative-pressure communication passage 29, the air-supply communication passage 30, the second inflow communication passage 32, and the second discharge communication passage 33 is formed.

In addition, the first discharge inflow port 31*b*, the first inflow port 28*a*, the ejector-side air-supply port 30*b*, the second inflow port 32*a*, and the second discharge inflow port 33*a* are formed in the first attachment surface 20*a* of the ejector 20. The first attachment surface 20*a* is formed in a planar shape extending in the longitudinal direction, and when the lower end surface 42*b* of the corresponding switching valve 40 is disposed on the first attachment surface 20*a* so as to face the first attachment surface 20*a*, these ports 31*b*, 28*a*, 30*b*, 32*a*, and 33*a* are connected to their respective ports EA, A, P, B, and EB of the switching valve 40.

In contrast, the first discharge outflow port 31*a*, the first negative-pressure supply port 29*c*, the air-supply inflow port 30*a*, the second negative-pressure supply port 29*d*, and the second outflow port 33*b* are formed in the second attachment surface 20*b* of the ejector 20 in this order from the rear side to the front side. The second attachment surface 20*b* is formed in a planar shape extending in the longitudinal direction, and when the upper end surface 18*a* of the corresponding manifold base 10 is disposed on the second attachment surface 20*b* so as to face the second attachment surface 20*b*, these ports 31*a*, 29*c*, 30*a*, 29*d*, and 33*b* are connected to their respective ports 12*b*, 16*a*, 11*b*, 17*a*, and 13*b* of the manifold base 10.

As described above, according to the ejector 20 of the present embodiment, an upper end portion of the ejector 20 has the first attachment surface 20*a* to which the corresponding switching valve 40 is fixedly attached, and a lower end portion of the ejector 20 has the second attachment surface 20*b* to which the corresponding manifold base 10 is fixedly attached. The internal passage 27 that communicates with the switching valve 40, the manifold base 10, and the negative-pressure generating mechanism 22, which is disposed in the ejector 20, is formed in the ejector 20. Thus, manufacture of the corresponding vacuum generating device 1 is completed by only mounting the switching valve 40 and the manifold base 10 onto the first attachment surface 20*a* and the second attachment surface 20*b* of the ejector 20, respectively. Therefore, the ejector 20 that is capable of suppressing an increase in an installation space for the switching valve 40, the ejector 20, the manifold base 10, and a pipe compared with the case where the switching valve 40 or the manifold base 10 is connected to the ejector 20 via a pipe or the like and capable of suppressing an increase in the time and effort for the connecting operation and the vacuum generating device 1 that includes the ejector 20 can be provided.

As illustrated in FIG. 3, in the vacuum generating device 1 having a configuration such as that described above, in a state where the second pilot valve 44*b* of the switching valve 40 is switched off such that the pilot fluid pressure is not applied to the second piston 52, when the first pilot valve 44*a* is switched on such that the pilot fluid pressure is applied to the first piston 51, the spool 50 moves to the second-end-side switching position P2. In a state where the spool 50 has moved to the second-end-side switching position P2, when compressed air is introduced from the air-supply hole 11, the compressed air flows into the switching-valve-side air-supply inflow port P of the switching valve 40 through the air-supply passage 11*a* and the air-supply communication passage 30. Then, the compressed air flows into the first output port A and the supply passage 28 of the ejector 20 through the switching-valve-side air-supply inflow port P. As a result, the compressed air flows into the negative-pressure generating mechanism 22, so that the air in the vacuum device is drawn in through the negative-pressure communication passage 29 and the first and second negative-pressure passages 16 and 17 of the manifold base 10, and the pressure in the vacuum device can become a negative pressure.

In addition, as illustrated in FIG. 3, in a state where the spool 50 has moved to the second-end-side switching position P2, when the first pilot valve 44*a* is switched off such that the pilot fluid pressure is not applied to the first piston 51, as illustrated in FIG. 5, the first spring seat 66*a* is moved to the rear side by an urging force of the compression spring 67, and the spool 50 is moved to the rear side by receiving the urging force via the second airtight portion 63, which is in contact with the first spring seat 66*a*. Then, when the first spring seat 66*a* comes into contact with the end wall 69*a* on the rear side of the spring accommodating chamber 69, the spool 50 stops moving, and the spool 50 is switched to the neutral switching position Ps. Accordingly, the switching valve 40 is brought into the non-communication state in which all the ports EA, A, P, B, and EB are closed, and thus, the first and second negative-pressure passages 16 and 17 of the manifold base 10 are brought into a closed state, so that the vacuum state of the vacuum device that is connected to these negative-pressure passages can be maintained. In other words, in a state where the spool 50 has moved to the second-end-side switching position P2, when the first pilot valve 44*a* is switched off due to, for example, a power failure, the spool 50 is switched to the neutral switching position Ps, and thus, the vacuum state of the vacuum device is maintained.

In contrast, as illustrated in FIG. 4, in a state where the first pilot valve 44*a* of the switching valves 40 is switched off such that the pilot fluid pressure is not applied to the first piston 51, when the second pilot valve 44*b* is switched on such that the pilot fluid pressure is applied to the second piston 52, the spool 50 moves to the first-end-side switching position P1. In a state where the spool 50 has moved to the first-end-side switching position P1, the compressed air supplied through the air-supply hole 11 flows into the first and second negative-pressure passages 16 and 17 of the manifold base 10 through the air-supply passage 11*a* of the manifold base 10, the air-supply communication passage 30 of the ejector 20, the switching-valve-side air-supply inflow port P and the second output port B of the switching valve 40, the second inflow communication passage 32, and the negative-pressure communication passage 29. Thus, the compressed air is supplied to the vacuum device that is connected to the manifold base 10, and the vacuum in the vacuum device can be broken (a positive pressure can be supplied).

In the above-described vacuum generating devices 1 of the first embodiment, the second inflow communication passage 32 of the ejector 20 communicates with the first and second negative-pressure passages 16 and 17 of the manifold base 10 through the negative-pressure communication passage 29, and thus, compressed air can be supplied to the vacuum device through the first and second negative-pressure passages 16 and 17. However, the flow rate of the compressed air cannot be adjusted. Accordingly, the flow rate of the compressed air that is supplied to the vacuum device may be adjustable (a first modification).

Figure 6:
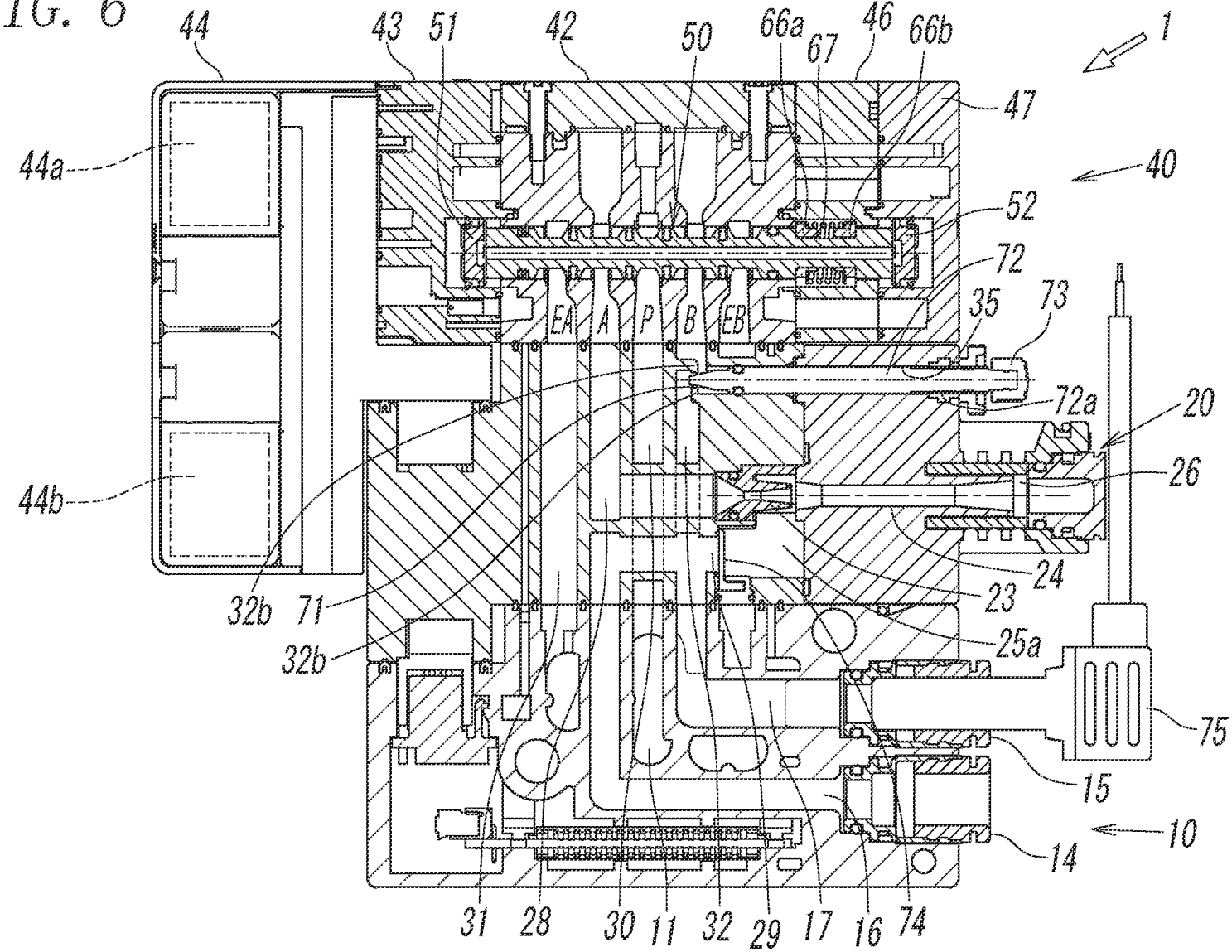
FIG. 6 is a sectional view illustrating a first modification of the vacuum generating device according to the first embodiment.

In this case, as illustrated in FIG. 6, an orifice 71 may be provided in the second inflow communication passage 32, and a needle valve 72 may be movably provided for the orifice 71 in order to make the opening area of the orifice 71 adjustable. The orifice 71 is disposed between a pair of projecting pieces 32*b* and 32*b*, which are arranged in the second inflow communication passage 32 so as to be spaced apart from each other in the vertical direction, and is open in such a manner as to have a circular opening. The opening of the orifice 71 is oriented in the L-axis direction.

The needle valve 72 is formed in a cylindrical shape extending in the longitudinal direction, and an end portion (a rear portion) of the needle valve 72 in the axial direction of the needle valve 72 is formed in a conical shape. The rear portion of the needle valve 72 is inserted in the opening of the orifice 71 such that the needle valve 72 is movable in the longitudinal direction with respect to the orifice 71. Thus, by adjusting the position of the rear portion of the needle valve 72 with respect to the orifice 71, the opening area of the orifice 71 changes, and the flow rate of the compressed air that flows through the second inflow communication passage 32 can be adjusted.

In this modification, a hole 35 that extends in the longitudinal direction is formed at the front side of the ejector 20, and a rear end portion of the hole 35 and a front end portion of the hole 35 are respectively open to the second inflow communication passage 32 and the front surface of the ejector 20. The needle valve 72 is accommodated in the hole 35 so as to be movable in the longitudinal direction. The needle valve 72 includes an external thread portion 72*a* that is formed on the outer peripheral surface a front portion of the needle valve 72, and an internal thread portion (not illustrated) into which the external thread portion 72*a* is screwed is formed in an upper front portion of the ejector 20. In addition, a knob 73 is provided at a front end portion of the needle valve 72, and by rotating the knob 73, the needle valve 72 is moved in the L-axis direction with respect to the ejector 20, and the flow rate of the compressed air that flows through the second inflow communication passage 32 can be adjusted.

A check valve 74 that allows the flow of air from the negative-pressure communication passage 29 toward the communication space 25*a* and limits the flow of the air in the opposite direction, that is, the flow of the air from the communication space 25*a* toward the negative-pressure communication passage 29 may be provided at a connection position where the negative-pressure communication passage 29 and the communication space 25*a* are connected to each other (a second modification). By providing the check valve 74, the flow of the air from the outside into the negative-pressure communication passage 29 through the diffuser unit 24 can be limited, and thus, an increase in the flow rate of the air that flows from the negative-pressure communication passage 29 into the first and second negative-pressure passages 16 and 17 of the manifold base 10 can be prevented.

A pressure sensor 75 for measuring the pressure of compressed air may be provided in the second negative-pressure port 15 of the manifold base 10 (a third modification).

In this case, a state in which a workpiece is sucked in and held on a vacuum pad (a vacuum device) can be confirmed on the basis of a value (a vacuum pressure value) that is detected by the pressure sensor 75. More specifically, when the vacuum device sucks in a workpiece and the vacuum pressure value reaches a predetermined value, control for switching to an ejector non-operating state (all the passages are not in communication) is performed, and the workpiece can be held. In addition, during the period when the ejector is not operating, a decrease in the vacuum pressure due to air leakage between a workpiece and the pad can be monitored by the pressure sensor, and control for reactivating the ejector when the vacuum pressure value exceeds a threshold can be performed. By repeating these controls, the amount of air used by activation of the ejector can be reduced while preventing the workpiece from falling. In the third modification, although a case has been described in which the pressure sensor 75 is inserted into the second negative-pressure port 15 and in which the vacuum device is connected to the first negative-pressure port 14, the pressure sensor 75 may be inserted into the first negative-pressure port 14, and the vacuum device may be connected to the second negative-pressure port 15.

Second Embodiment

A second embodiment of the vacuum generating device 1 according to the present invention will now be described. Differences between the second embodiment and the above-described first embodiment will be mainly described. Components of the second embodiment that are the same as those of the first embodiment will be denoted by the same reference signs, and descriptions thereof will be omitted.

Figure 7:
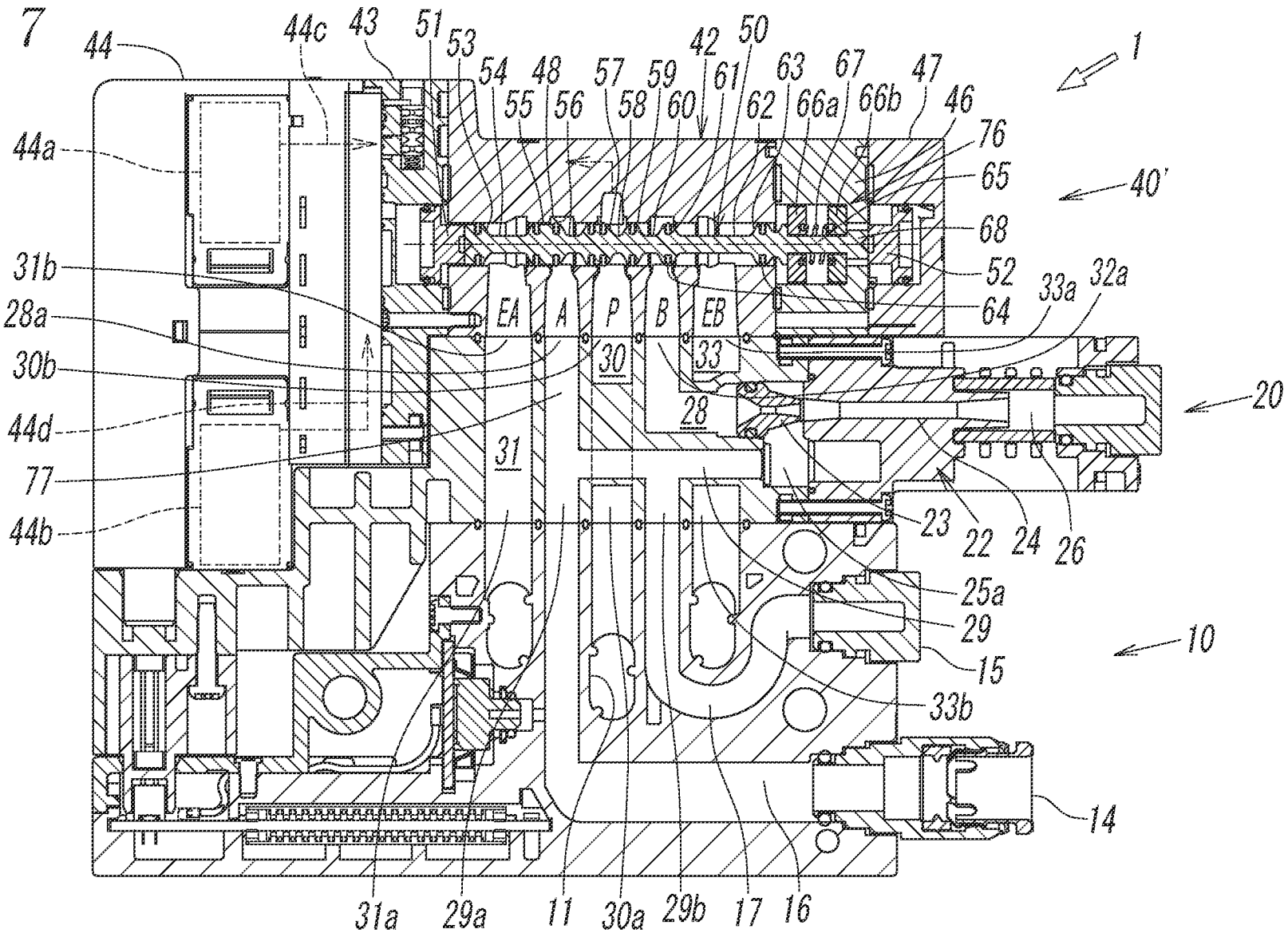
FIG. 7 is a sectional view of a vacuum generating device according to a second embodiment of the present invention that includes a four-position switching valve.

As illustrated in FIG. 7, a switching valve 40' is a four-position switching valve. In the spool 50, a sliding surface of the first land portion 55 and a sliding surface of the second land portion 57 each have a width that is larger than the width of a sliding surface of the third land portion 59 and larger than the width of a sliding surface of the fourth land portion 61 in the L-axis direction, and the width of the sliding surface of the first land portion 55 is larger than the width of the sliding surface of the second land portion 57. In addition, the sliding surface of the first land portion 55 and the sliding surface of the second land portion 57 are each provided with two packing members 64.

As illustrated in FIG. 8 to FIG. 11, a spool moving mechanism unit 76 that selectively moves the spool 50 to a first intermediate switching position P3 (see FIG. 9) and a second intermediate switching position P4 (see FIG. 10) is disposed on the front side of the spool 50, the first intermediate switching position P3 and the second intermediate switching position P4 being located between the first-end-side switching position P1 (see FIG. 8) and the second-end-side switching position P2 (see FIG. 11) and being different from each other. In the present embodiment, the present embodiment is located further toward the rear side than the second intermediate switching position P4. The spool moving mechanism unit 76 is formed so as to include the first and second spring seats 66*a* and 66*b* that are arranged on the spring seat shaft 65, which extends from the second airtight portion 63 of the spool 50, so as to be freely movable in the L-axis direction and the compression spring 67 that is disposed between the first spring seat 66*a* and the second spring seat 66*b* as in the first embodiment.

The length Y in the axial direction between the end walls 69*a* and 69*b* that are located on the two sides of the spring accommodating chamber 69 in the L-axis direction (hereinafter referred to as the "length Y between the pair of end walls") is longer than the length X in the L-axis direction between the first step portion 63*a* and the second step portion 68*a* that are located on the two sides of the spring seat shaft 65 in the axial direction (hereinafter referred to as the "length X between the pair of step portions") (see FIG. 9).

Figure 8:
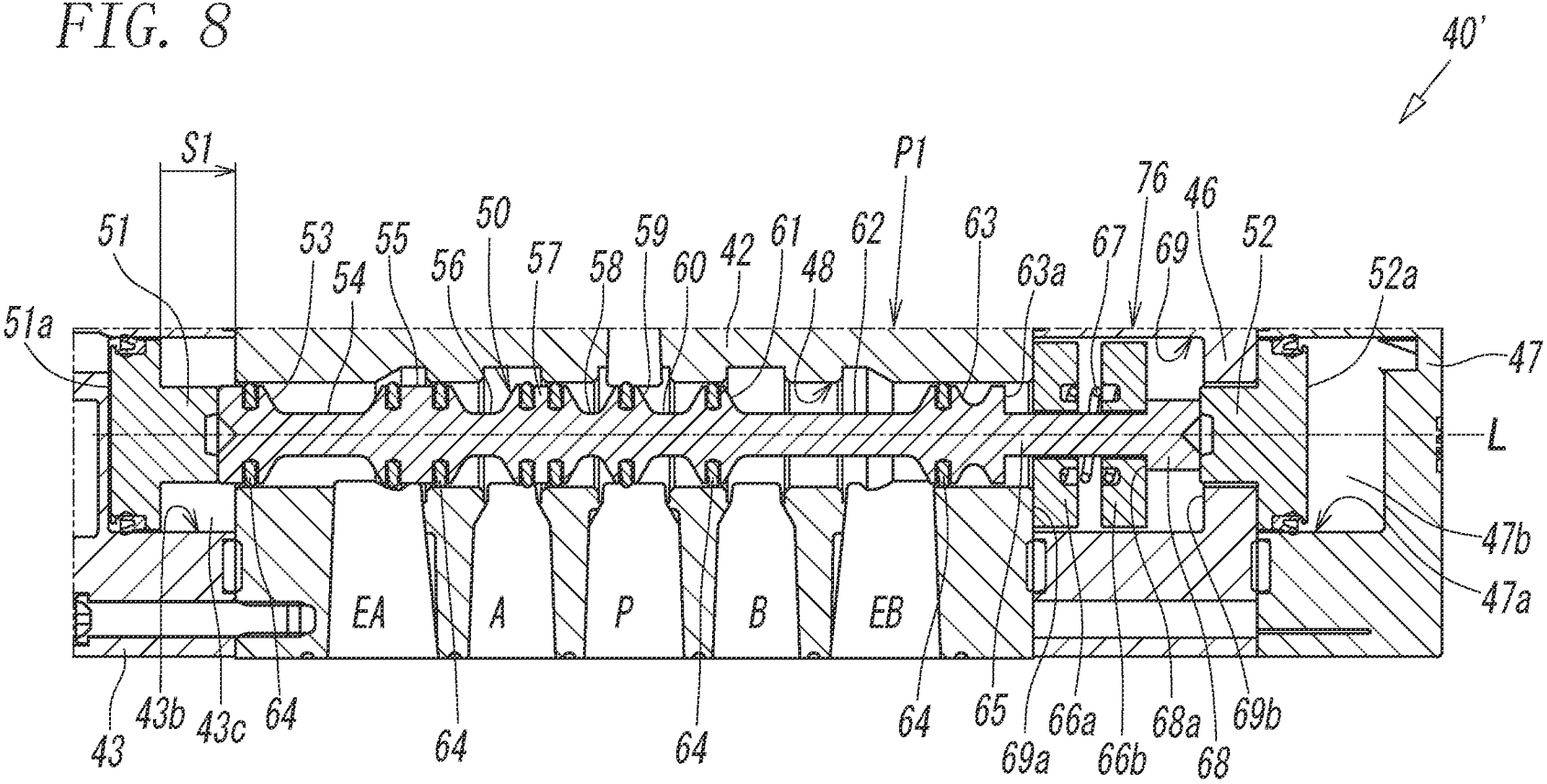
FIG. 8 is a sectional view illustrating a state where a spool of the switching valve according to the second embodiment has been switched to a first-end-side switching position.
Figure 11:
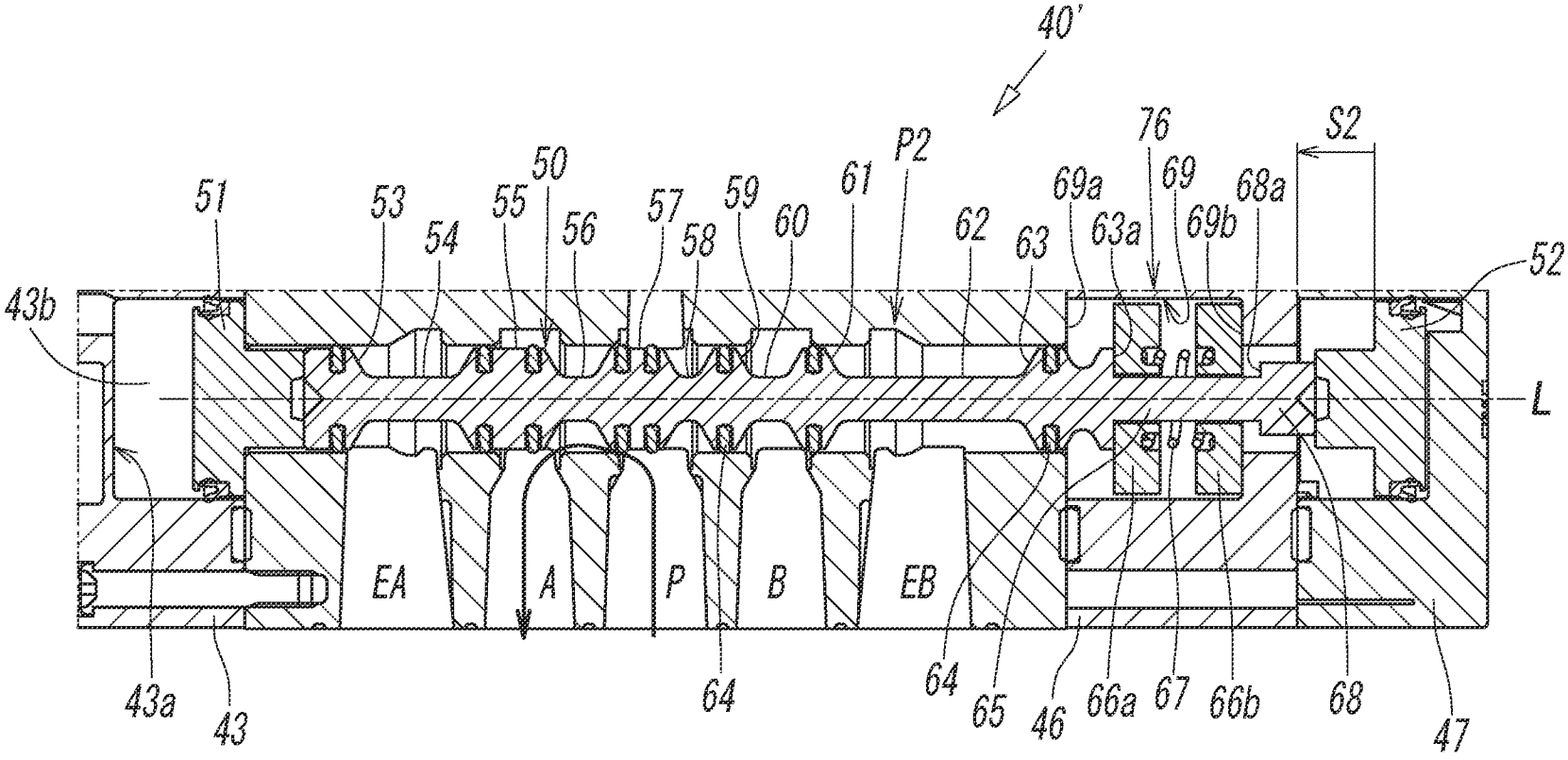
FIG. 11 is a sectional view illustrating a state where the spool of the switching valve according to the second embodiment has been switched to a second-end-side switching position.

Here, the distance travelled by the spool 50 in the L-axis direction, that is, the stroke length of the spool 50 will be described. In the present embodiment, the first-end-side switching position P1 illustrated in FIG. 8 is the position that is closest to the first side in the axial direction (the rear side) and to which the spool 50 is to be moved, and the second-end-side switching position P2 illustrated in FIG. 11 is the position that is closest to the second side in the axial direction (the front side) and to which the spool 50 is to be moved. Thus, the spool 50 travels the distance (a stroke length 5) between the first-end-side switching position P1 and the second-end-side switching position P2. In the present embodiment, a stroke length S1 (see FIG. 8) that is travelled by the spool 50 from the first side to the second side in the L-axis direction and a stroke length S2 (see FIG. 11) that is travelled by the spool 50 from the second side to the first side in the L-axis direction are the same as each other. In addition, each of the stroke lengths S1 and S2 is set to be larger than a value obtained by subtracting the length X between the pair of step portions from the length Y between the pair of end walls (Y−X) (see FIG. 9). In other words, this may be expressed as: Y−X<S1, S2.

Thus, when the spool 50 that has moved to the second-end-side switching position P2 illustrated in FIG. 11 is moved to the first side in the L-axis direction (the rear side), as illustrated in FIG. 8, in a state where the first spring seat 66*a* is in contact with the end wall 69*a*, the second spring seat 66*b* is brought closer to the first spring seat 66*a*, so that the spool 50 can be moved to the first-end-side switching position P1. In addition, when the spool 50 that has moved to the first-end-side switching position P1 is moved to the second side in the L-axis direction (the front side), as illustrated in FIG. 11, in a state where the second spring seat 66*b* is in contact with the end wall 69*b*, the first spring seat 66*a* is brought closer to the second spring seat 66*b*, so that the spool 50 can be moved to the second-end-side switching position P2.

In the switching valve 40' that is configured as described above and that can be switched to four positions, as illustrated in FIG. 8, when the pilot air pressure is applied to the second piston 52, the first spring seat 66*a* comes into contact with the end wall 69*a* of the spring accommodating chamber 69, and the second spring seat 66*b* moves to the first side in the L-axis direction (the rear side) against the urging force of the compression spring 67, so that the spool 50 is switched to the first-end-side switching position P1. In addition, in a state where the spool 50 has been switched to the first-end-side switching position P1, when application of the pilot air pressure to the second piston 52 is stopped, as illustrated in FIG. 9, the first spring seat 66*a* comes into contact with the end wall 69*a* of the spring accommodating chamber 69 and the first step portion 63*a*, and the second spring seat 66*b* and the spool 50 are moved to the second side in the L-axis direction (the front side) by the return force (spring force) of the compression spring 67 so as to bring the second spring seat 66*b* into contact with the second step portion 68*a*, so that the spool 50 is switched to the first intermediate switching position P3.

In addition, as illustrated in FIG. 11, when the pilot air pressure is applied to the first piston 51, the second spring seat 66*b* comes into contact with the end wall 69*b* of the spring accommodating chamber 69, and the first spring seat 66*a* moves to the second side in the L-axis direction (the front side) against the urging force of the compression spring 67, so that the spool 50 is switched to the second-end-side switching position P2. In a state where the spool 50 has been switched to the second-end-side switching position P2, when application of the pilot air pressure to the first piston 51 is stopped, as illustrated in FIG. 10, the second spring seat 66*b* comes into contact with the end wall 69*b* of the spring accommodating chamber 69, and the first spring seat 66*a* and the spool 50 are moved to the first side in the L-axis direction (the rear side) by the return force (spring force) of the compression spring 67 so as to bring the first spring seat 66*a* and the second spring seat 66*b* into contact with the first step portion 63*a* and the second step portion 68*a*, respectively, so that the spool 50 is switched to the second intermediate switching position P4.

Figure 9:
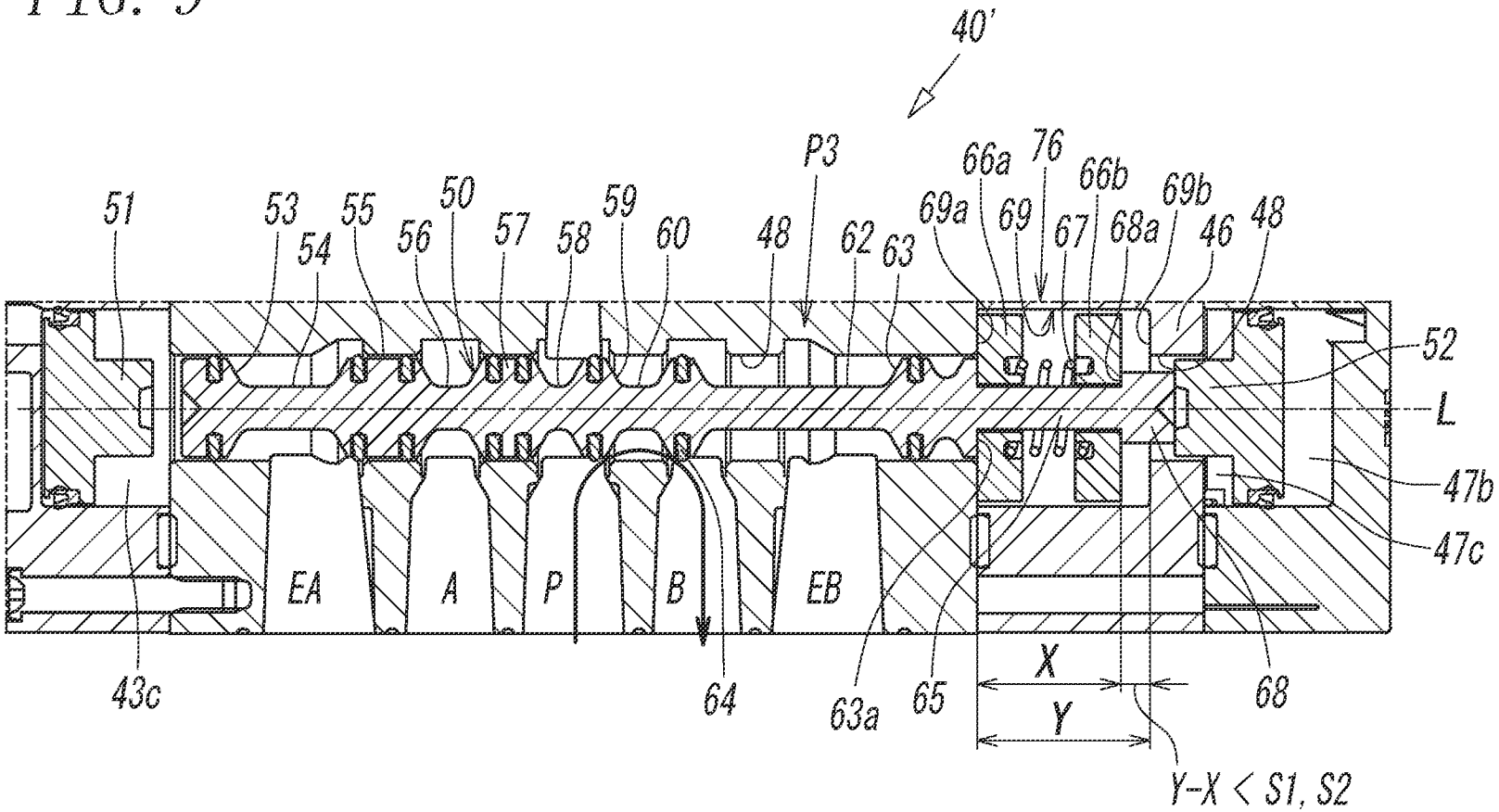
FIG. 9 is a sectional view illustrating a state where the spool of the switching valve according to the second embodiment has been switched to a first intermediate switching position.
Figure 10:
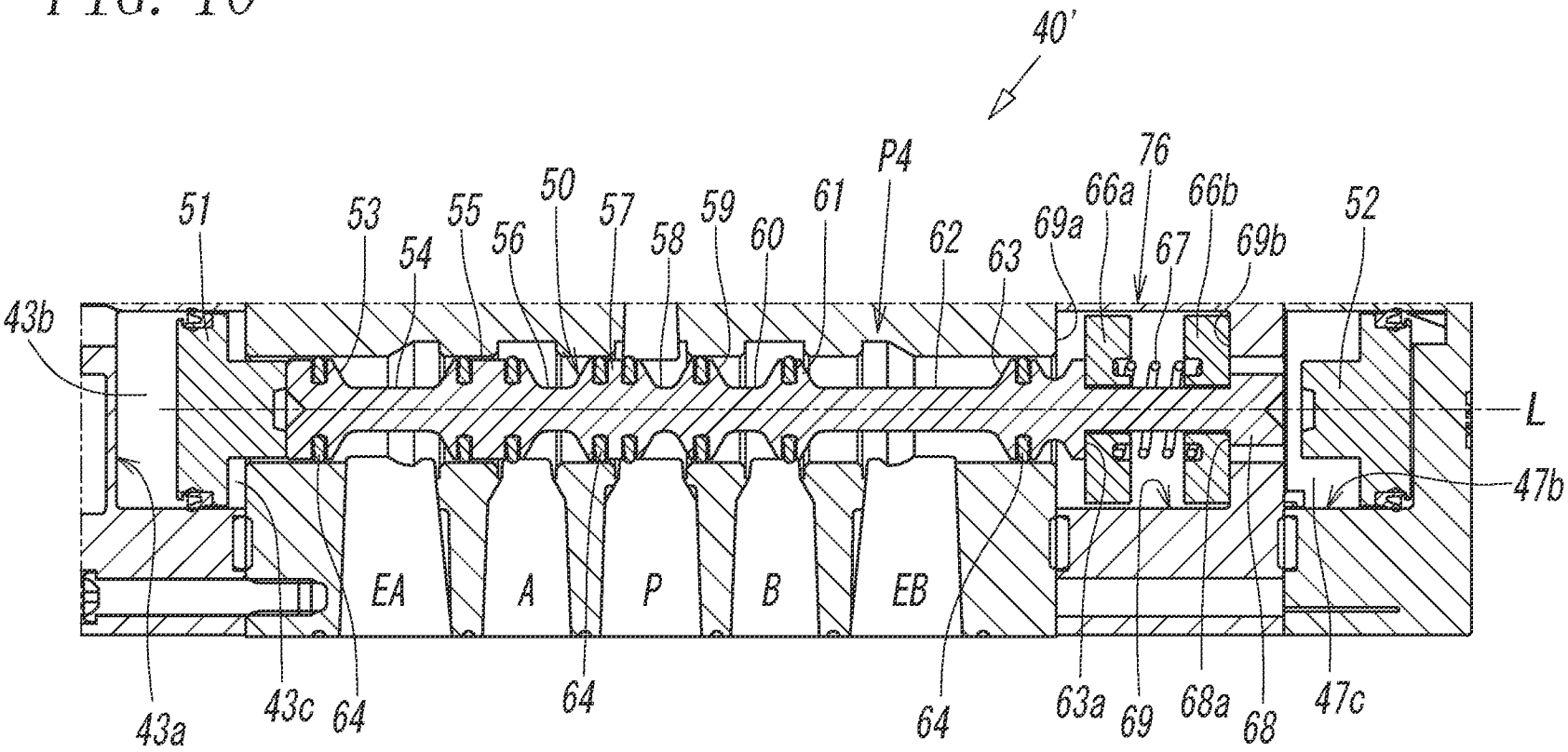
FIG. 10 is a sectional view illustrating a state where the spool of the switching valve according to the second embodiment has been switched to a second intermediate switching position.

As described above, in a state where the pilot air pressure is not applied to either the first piston 51 or the second piston 52, as illustrated in FIG. 9 and FIG. 10, the spool 50 of the present embodiment can be switched to the two intermediate switching positions, which are the first intermediate switching position P3 to which the spool 50 is switched as a result of the second spring seat 66*b* and the spool 50 being moved to the second side in the L-axis direction (the front side) by the return force (spring force) of the compression spring 67 and the second intermediate switching position P4 that is located further toward the second side in the L-axis direction than the first intermediate switching position P3 and to which the spool 50 is switched as a result of the first spring seat 66*a* and the spool 50 being moved to the first side in the L-axis direction (the rear side) by the return force (spring force) of the compression spring 67.

As illustrated in FIG. 8, when the spool 50 is switched to the first-end-side switching position P1, the switching valve 40' is brought into a first non-communication state in which the switching-valve-side air-supply inflow port P, the first output port A, the second output port B, and the first discharge port EA are closed so as not to communicate with one another. As illustrated in FIG. 9, when the spool 50 is switched to the first intermediate switching position P3, the switching valve 40' is brought into a first communication state in which the first output port A, the first discharge port EA are closed so as not to communicate with each other and in which the switching-valve-side air-supply inflow port P and the second output port B communicate with each other.

As illustrated in FIG. 10, when the spool 50 is switched to the second intermediate switching position P4, the switching valve 40' is brought into a second non-communication state in which the switching-valve-side air-supply inflow port P, the first output port A, the second output port B, the first discharge port EA, and the second discharge port EB are all closed so as not to communicate with one another. As illustrated in FIG. 11, when the spool 50 is switched to the second-end-side switching position P2, the switching valve 40' is brought into the second communication state in which the second output port B, the first discharge port EA, and the second discharge port EB are closed so as not to communicate with one another and in which the switching-valve-side air supply inflow port P and the first output port A communicate with each other.

As illustrated in FIG. 7, the supply passage 28 of the ejector 20 that is connected to the switching valve 40', which is configured as described above, extends between the second inflow port 32*a* of the ejector 20, which is connected to the second output port B of the switching valve 40', and the nozzle unit 23. In addition, the first inflow port 28*a* of the ejector 20 that is in communication with the first output port A of the switching valve 40' and the negative-pressure communication passage 29 communicate with each other through a first inflow communication passage 77.

Figure 12:
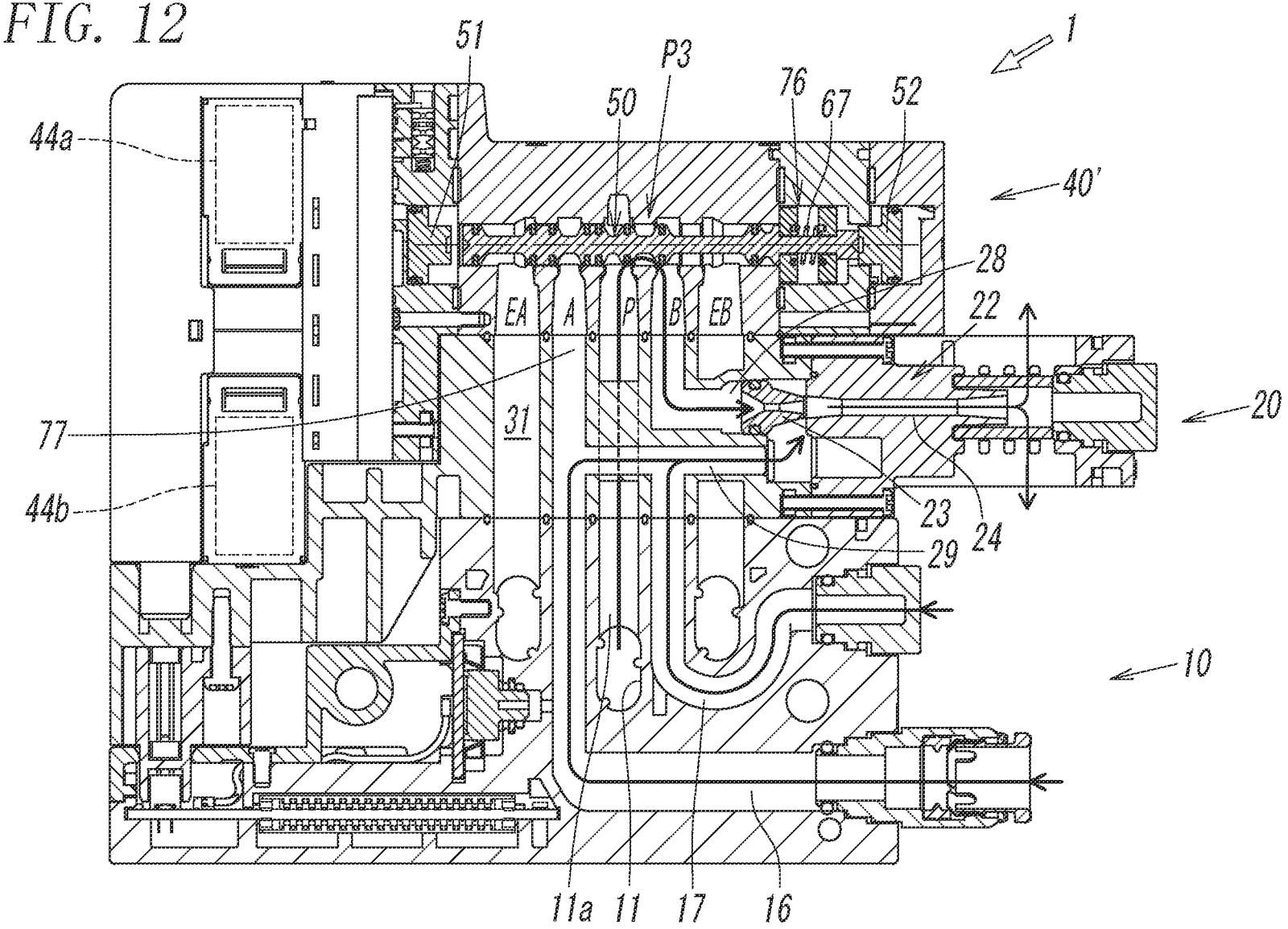
FIG. 12 is a diagram illustrating an operation of the vacuum generating device according to the second embodiment when it performs a negative-pressure operation.

Thus, in a state where the spool 50 has been switched to the first-end-side switching position P1 (see FIG. 8), when an emergency such as a situation where supply of power to the second pilot valve 44*b* (see FIG. 7) is discontinued occurs, as illustrated in FIG. 9, the spool 50 is switched to the first intermediate switching position P3 by the return force of the compression spring 67 such that the switching-valve-side air-supply inflow port P and the second output port B communicate with each other. Thus, as illustrated in FIG. 12, the compressed air supplied through the air-supply hole 11 passes through the air-supply passage 11*a* of the manifold base 10 and the air-supply communication passage 30 of the ejector 20 and flows into the supply passage 28 so as to be supplied to the negative-pressure generating mechanism 22. As a result of the compressed air flowing into the negative-pressure generating mechanism 22, the air in the vacuum device is drawn in through the negative-pressure communication passage 29 and the first and second negative-pressure passages 16 and 17 of the manifold base 10, so that the pressure in the vacuum device can become a negative pressure.

Figure 13:
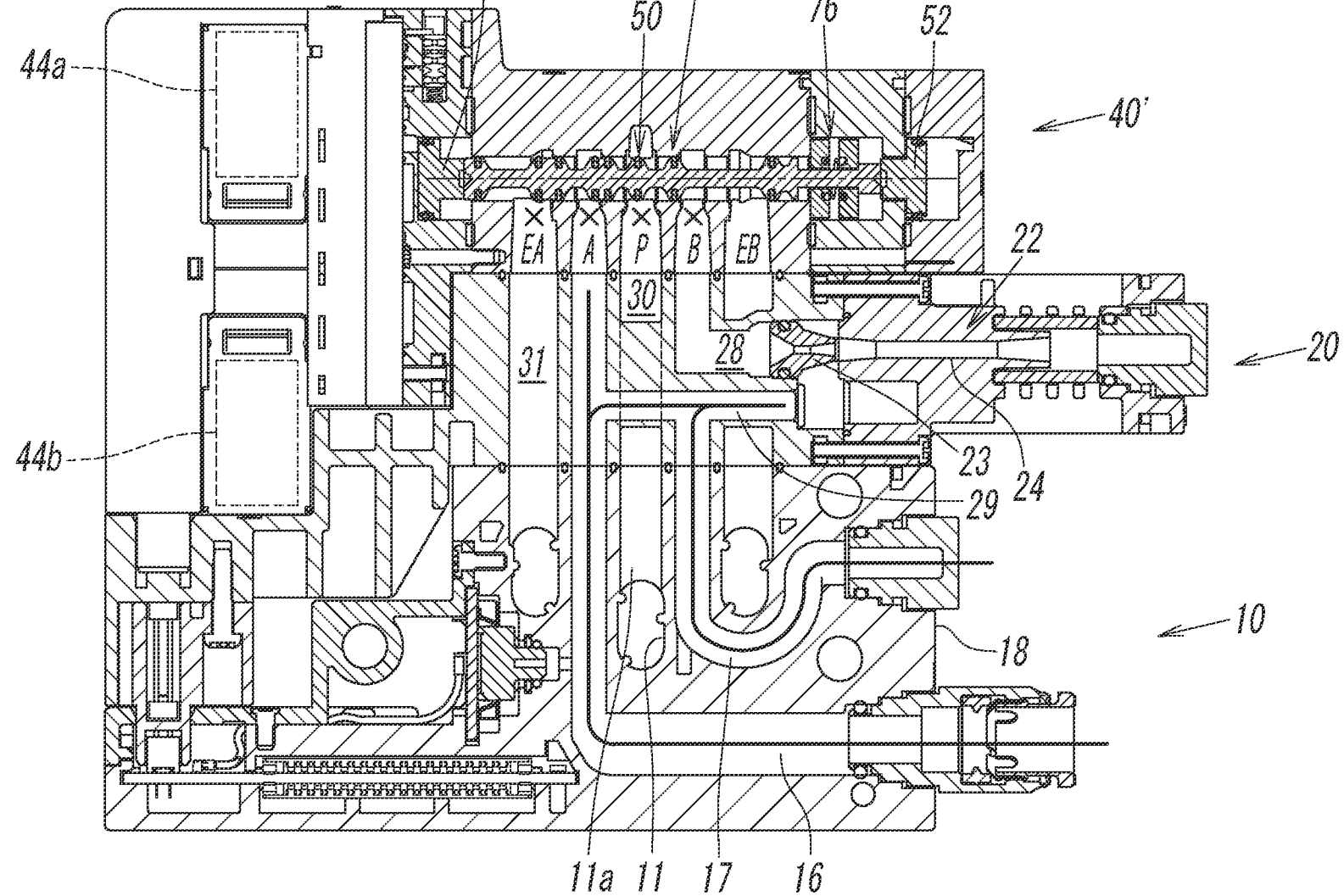
FIG. 13 is a diagram illustrating an operation of the vacuum generating device according to the second embodiment when it maintains a vacuum state.

In a state where the spool 50 has been switched to the first intermediate switching position P3, when the second pilot valve 44*b* is switched on, the spool 50 is switched to the first-end-side switching position P1 as illustrated in FIG. 13. Accordingly, all the ports EA, A, P, B, and EB of the switching valve 40' are closed, and thus, the vacuum device connected to the first and second negative-pressure passages 16 and 17 of the manifold base 10 can be maintained under the negative pressure.

Figure 14:
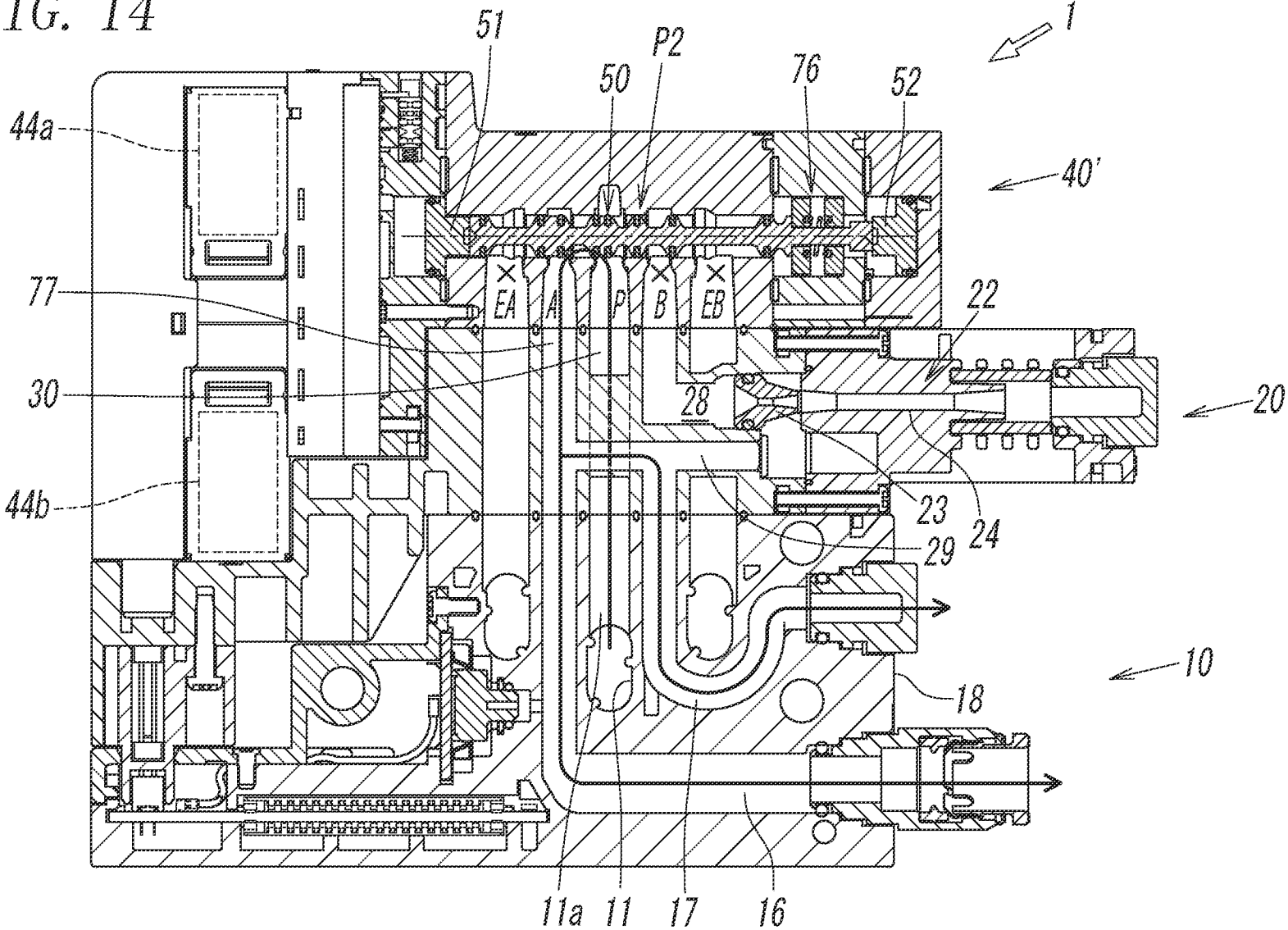
FIG. 14 is a diagram illustrating an operation of the vacuum generating device according to the second embodiment when it breaks a vacuum (when it supplies a positive pressure).

As illustrated in FIG. 14, when only the first pilot valve 44*a* is switched on, the spool 50 is switched to the second-end-side switching position P2. In a state where the spool 50 has been switched to the second-end-side switching position P2, the compressed air that is introduced through the air-supply hole 11 flows into the first and second negative-pressure passages 16 and 17 of the manifold base 10 through the air-supply passage 11*a* of the manifold base 10, the air-supply communication passage 30 of the ejector 20, the switching-valve-side air-supply inflow port P of the switching valve 40', the first output port A, the first inflow communication passage 77, and the negative-pressure communication passage 29. Thus, the compressed air is supplied to the vacuum device connected to the manifold base 10, and the vacuum in the vacuum device can be broken (a positive pressure can be supplied).

Figure 15:
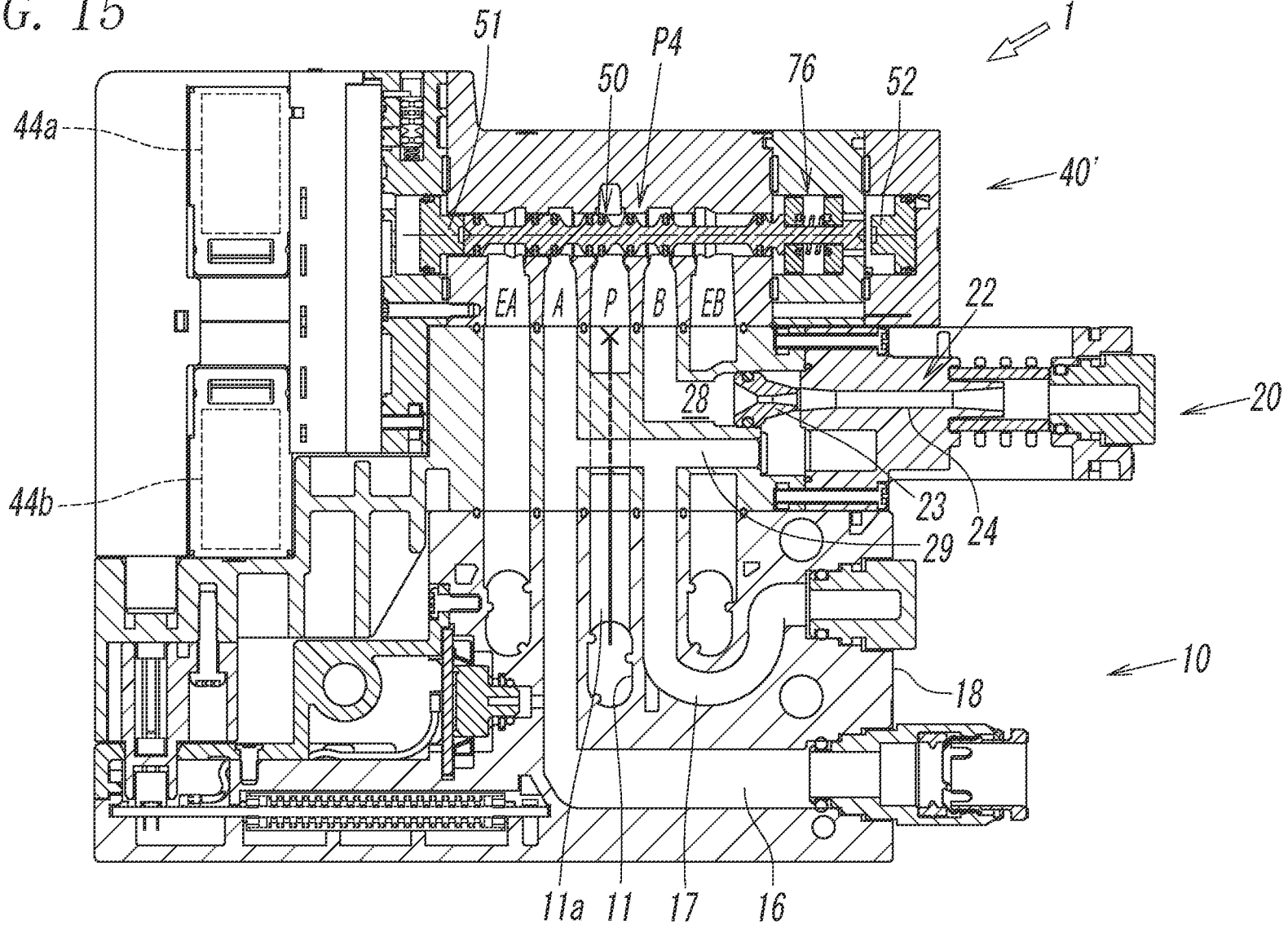
FIG. 15 is a diagram illustrating an operation of the vacuum generating device according to the second embodiment when vacuum breaking (supply of the positive pressure) is stopped.

In a state where the spool 50 has been switched to the second-end-side switching position P2, when the first pilot valve 44*a* is switched off, the spool 50 is switched to the second intermediate switching position P4 as illustrated in FIG. 15, and all the ports EA, A, P, B, and EB of the switching valve 40' are closed. Consequently, supply of the compressed air to the first and second negative-pressure passages 16 and 17 of the manifold is stopped, and thus, breaking the vacuum in the vacuum device (supply of a positive pressure) can be stopped.

As described above, according to the ejector 20 of the present embodiment, manufacture of the vacuum generating device 1 is completed by only attaching the switching valve 40' to the first attachment surface 20*a* of the ejector 20 and attaching the manifold base 10 to the second attachment surface 20*b* of the ejector 20. Thus, the ejector 20 that is capable of suppressing an increase in an installation space for the switching valve 40', the ejector 20, the manifold base 10, and pipes for connecting them and capable of suppressing an increase in the time and effort for the connecting operation and the vacuum generating device 1 that includes the ejector 20 can be provided.

Third Embodiment

A third embodiment of the vacuum generating device 1 according to the present invention will now be described with reference to FIG. 16 to FIG. 19. Differences between the third embodiment and the above-described first embodiment will be mainly described. Components of the third embodiment that are the same as those of the first embodiment will be denoted by the same reference signs, and descriptions thereof will be omitted.

Figure 16:
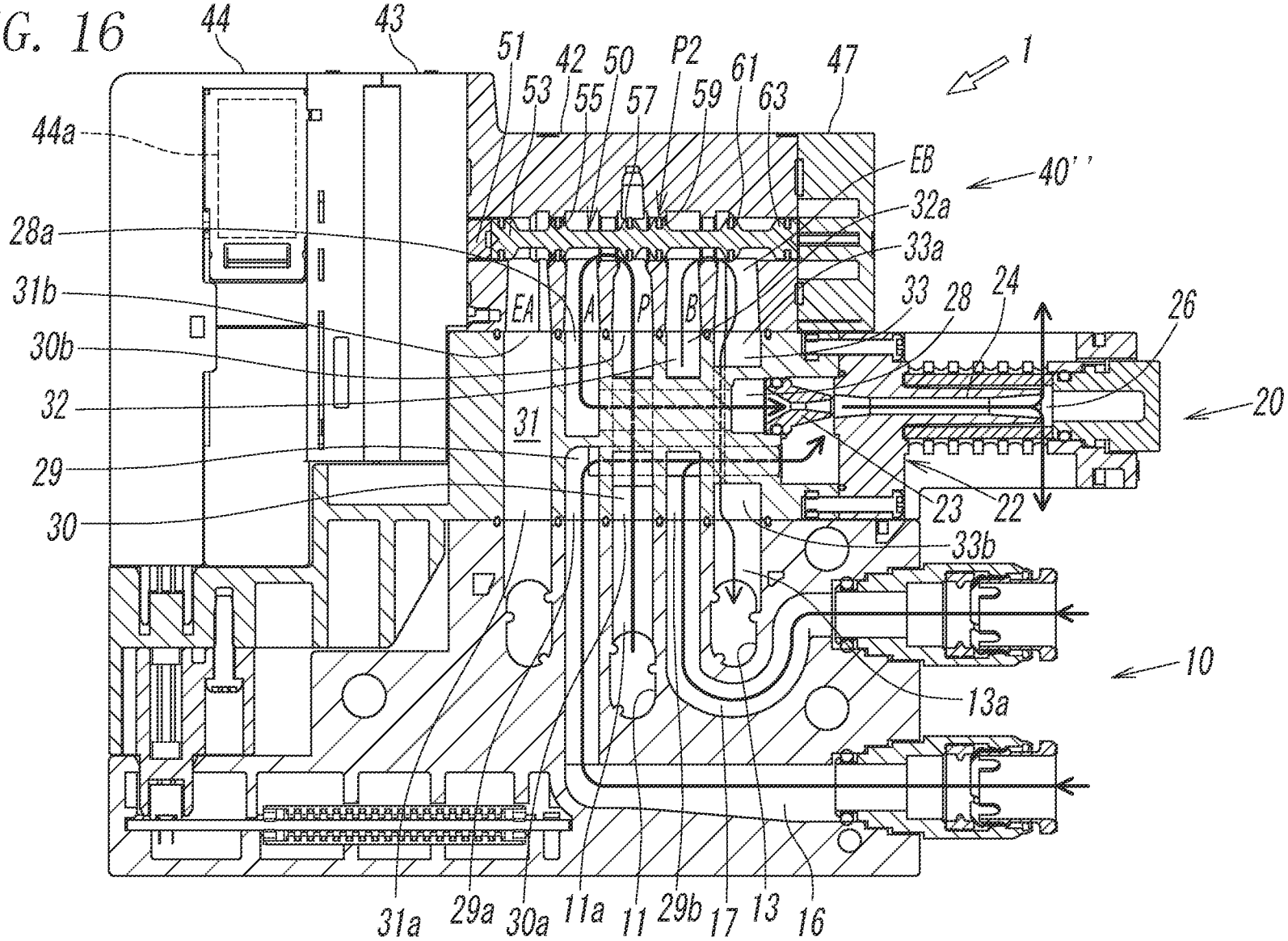
FIG. 16 is a diagram illustrating an operation of the vacuum generating device according to a third embodiment of the present invention that includes a two-position switching valve when the vacuum generating device performs a negative-pressure operation.
Figure 17:
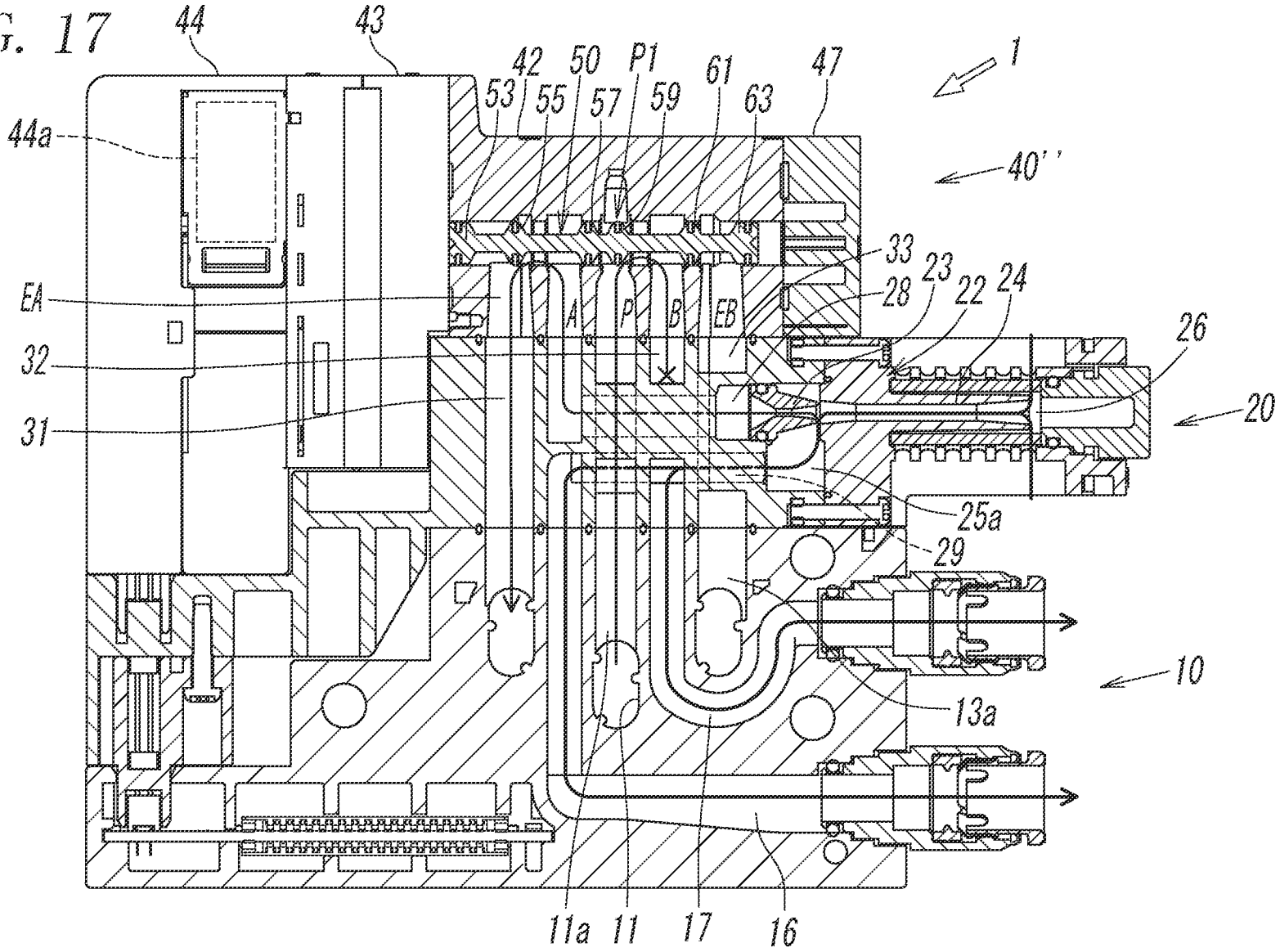
FIG. 17 is a diagram illustrating an operation of the vacuum generating device according to the third embodiment when it breaks a vacuum (when it supplies atmospheric pressure).

As illustrated in FIG. 16 and FIG. 17, a switching valve 40" is a commonly known two-position switching valve, and a normally-closed two-position switching valve is used as the switching valve 40" in the present embodiment. The switching valve 40' includes a single first pilot valve 44*a*, and when the first pilot valve 44*a* is switched on, the spool 50 moves to the second-end-side switching position P2 (see FIG. 16) on the second side in the axial direction due to the pressure difference between the compressed air acting on one of the two end portions of the spool 50 in the axial direction and the compressed air acting on the other of the two end portions of the spool 50. When the first pilot valve 44*a* is switched off, the spool 50 moves to the first-end-side switching position P1 (see FIG. 17) on the first side in the axial direction (the rear side) by the compressed air that acts on only one end of the spool 50 in the axial direction.

In the spool 50 of the present embodiment, the gap between the second land portion 57 and the third land portion 59 in the axial direction is narrower than that in the spool 50 of the first embodiment. In addition, the second inflow communication passage 32 is closed at a position in front of the supply passage 28 and is not in communication with the negative-pressure communication passage 29. In contrast, the second discharge communication passage 33 extends through the ejector body 21 in the vertical direction and communicates with the second discharge branch passage 13*a* of the manifold base 10.

When the first pilot valve 44*a* is switched on, the spool 50 is switched to the second-end-side switching position P2 as illustrated in FIG. 16, and the switching valve 40" is brought into the first communication state in which the switching-valve-side air-supply inflow port P and the second output port B respectively communicate with the first output port A and the second discharge port EB and in which the first discharge port EA is closed. Thus, when compressed air is introduced through the air-supply hole 11, the compressed air flows through the air-supply passage 11*a* and the air-supply communication passage 30 and flows into the supply passage 28 of the ejector 20 through the switching-valve-side air-supply inflow port P and the first output port A of the switching valve 40". As a result of the compressed air flowing into the negative-pressure generating mechanism 22, the air in the vacuum device is drawn in through the negative-pressure communication passage 29 and the first and second negative-pressure passages 16 and 17 of the manifold base 10, so that the pressure in the vacuum device can become a negative pressure.

In contrast, when the first pilot valve 44*a* is switched off, the spool 50 is switched to the first-end-side switching position P1 as illustrated in FIG. 17, and the switching valve 40" is brought into the second communication state in which the switching-valve-side air-supply inflow port P and the first output port A respectively communicate with the second output port B and the first discharge port EA and in which the second discharge port EB is closed. Accordingly, the first and second negative-pressure passages 16 and 17 of the manifold base 10 communicate with the negative-pressure communication passage 29, the communication space 25*a*, the diffuser unit 24, and the discharge port 26 of the ejector 20, and thus, the atmospheric pressure is supplied to the vacuum device through them. Therefore, the vacuum in the vacuum device can be broken by the atmospheric pressure (the atmospheric pressure can be supplied).

Note that, when compressed air is introduced through the air-supply hole 11, although the compressed air flows into the second inflow communication passage 32 through the switching-valve-side air-supply inflow port P and the second output port B of the switching valve 40", since the second inflow communication passage 32 is not in communication with the negative-pressure communication passage 29, the compressed air does not flow into the first and second negative-pressure passages 16 and 17 of the manifold base 10. Thus, the vacuum in the vacuum device will not be broken by the compressed air (a positive pressure will not be supplied).

As described above, according to the ejector 20 of the present embodiment, manufacture of the vacuum generating device 1 is completed by only attaching the switching valve 40" to the first attachment surface 20*a* of the ejector 20 and attaching the manifold base 10 to the second attachment surface 20*b* of the ejector 20. Thus, the ejector 20 that is capable of suppressing an increase in an installation space for the switching valve 40", the ejector 20, the manifold base 10, and pipes for connecting them and capable of suppressing an increase in the time and effort for the connecting operation and the vacuum generating device 1 that includes the ejector 20 can be provided.

Figure 18:
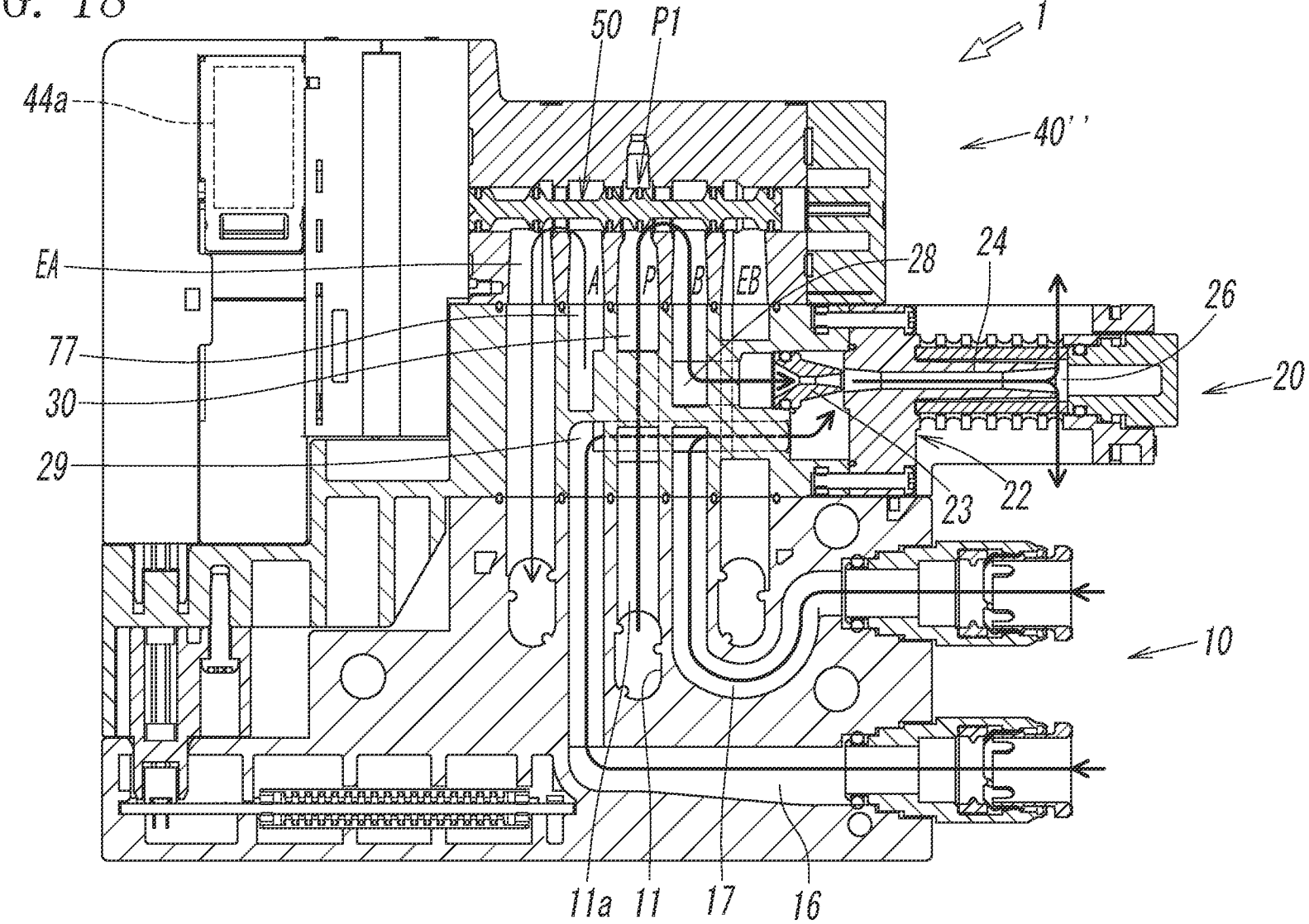
FIG. 18 is a diagram illustrating an operation of the vacuum generating device according to a modification of the third embodiment that includes a two-position switching valve when the vacuum generating device performs a negative-pressure operation.

Although the normally-closed two-position switching valve 40" has been described above, the switching valve 40" may be a normally-open switching valve (a fourth modification). As illustrated in FIG. 18, the switching valve 40" of this modification is a commonly known two-position switching valve and includes a single first pilot valve 44*a*. The switching valve 40" is configured such that, when the first pilot valve 44*a* is switched on, the spool 50 moves to the second-end-side switching position P2 (see FIG. 19) on the second side in the axial direction due to the pressure difference between the compressed air acting on one of the two end portions of the spool 50 in the axial direction and the compressed air acting on the other of the two end portions of the spool 50, and such that, when the first pilot valve 44*a* is switched off, the spool 50 moves to the first-end-side switching position P1 (see FIG. 18) on the first side in the axial direction (the rear side) by the compressed air that acts on only one end of the spool 50 in the axial direction.

Figure 19:
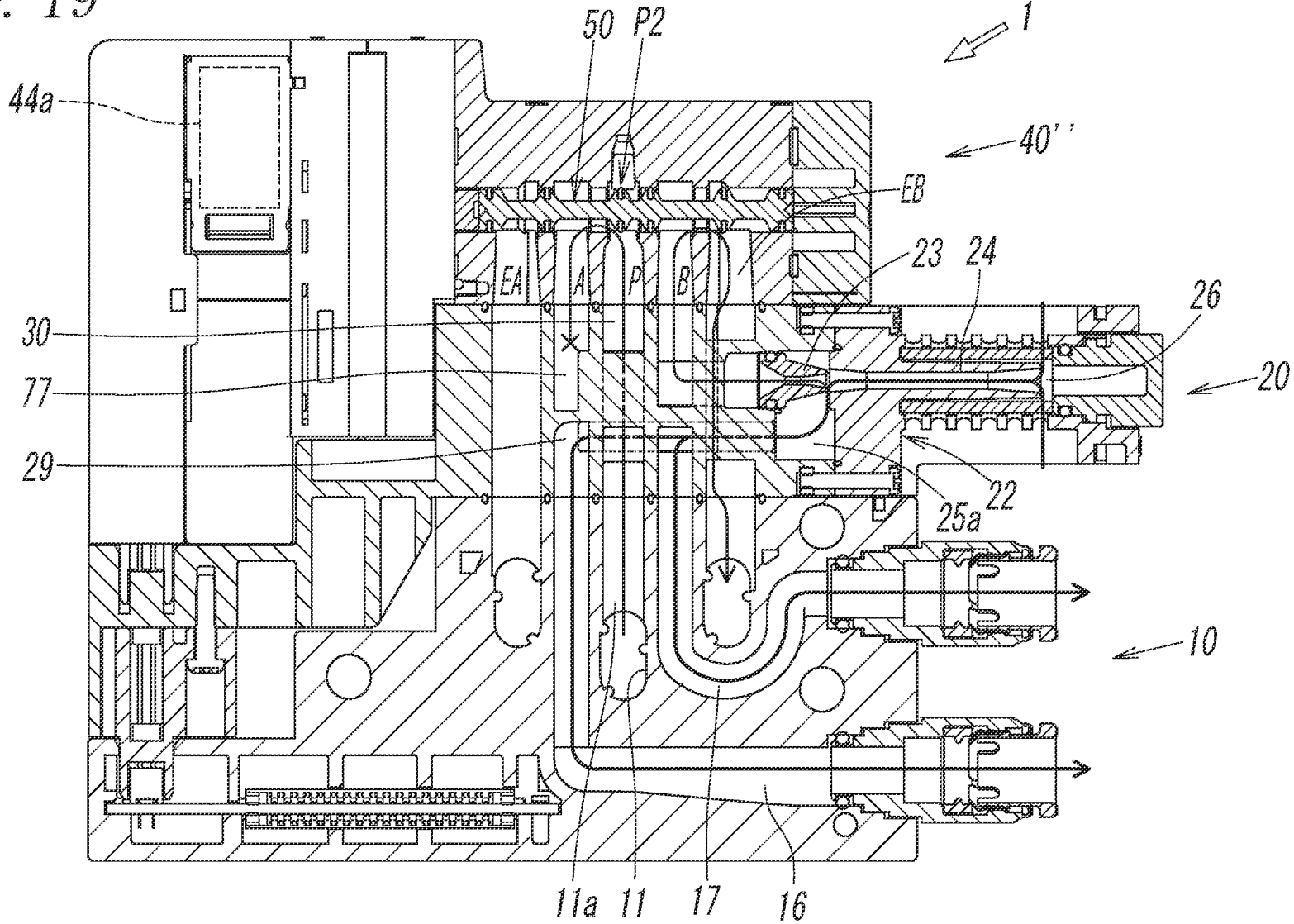
FIG. 19 is a diagram illustrating an operation of the vacuum generating device according to the modification of the third embodiment including the two-position switching valve when the vacuum generating device breaks a vacuum (when the vacuum generating device supplies atmospheric pressure).

When the spool 50 is switched to the first-end-side switching position P1, the switching valve 40" is brought into the first communication state in which the switching-valve-side air-supply inflow port P and the first output port A respectively communicate with the second output port B and the first discharge port EA and in which the second discharge port EB is closed. When the spool 50 is switched to the second-end-side switching position P2, as illustrated in FIG. 19, the switching valve 40" is brought into the second communication state in which the switching-valve-side air-supply inflow port P and the second output port B respectively communicate with the first output port A and the second discharge port EB and in which the first discharge port EA is closed.

The supply passage 28 of the ejector 20 is in communication with the second output port B of the switching valve 40". In addition, the first inflow communication passage 77 of the ejector 20 communicates with the first output port A of the switching valve 40" and is closed at a position in front of the negative-pressure communication passage 29.

Accordingly, when the spool 50 is switched to the second-end-side switching position P2 by switching on the first pilot valve 44*a*, the flow of the compressed air introduced through the air-supply hole 11 is blocked in the first inflow communication passage 77, and the compressed air will not flow into the first and second negative-pressure passages 16 and 17 of the ejector 20. In contrast, the negative-pressure communication passage 29 is in communication with the atmosphere through the communication space 25*a*, the diffuser unit 24, and the discharge port 26, and thus, the atmosphere passes through them and is supplied to the vacuum device. Therefore, the vacuum in the vacuum device can be broken by the atmospheric pressure (the atmospheric pressure can be supplied).

In contrast, when the first pilot valve 44*a* is switched off, the spool 50 is switched to the first-end-side switching position P1 as illustrated in FIG. 18. Then, when compressed air is introduced through the air-supply hole 11, the compressed air flows through the air-supply passage 11*a* and the air-supply communication passage 30 and flows into the supply passage 28 of the ejector 20 through the switching-valve-side air-supply inflow port P and the second output port B of the switching valve 40". As a result of the compressed air flowing into the negative-pressure generating mechanism 22, the air in the vacuum device is drawn in through the negative-pressure communication passage 29 and the first and second negative-pressure passages 16 and 17 of the manifold base 10, so that the pressure in the vacuum device can become a negative pressure.

Note that, in each of the above-described embodiments, although a case has been described in which the first attachment surface 20*a* and the second attachment surface 20*b* of the ejector 20 are respectively formed at the upper end and the lower end of the ejector body 21 so as to extend parallel to each other, the present invention is not limited to this case. The first attachment surface 20*a* and the second attachment surface 20*b* may be respectively formed at the upper end and the lower end of the ejector body 21 so as to extend in directions in which the first attachment surface 20*a* and the second attachment surface 20*b* cross each other.

REFERENCE SIGNS LIST

1 vacuum generating device
10, 91*a* manifold base
11 air-supply hole
11*a* air-supply passage
11*b* air-supply port
12 first discharge hole
12*a* first discharge branch passage
12*b*, 31*b* first discharge inflow port
13 second discharge hole
13*a* second discharge branch passage
13*b*, 33*a* second discharge inflow port
14 first negative-pressure port
15 second negative-pressure port
16 first negative-pressure passage
16*a* first negative-pressure inflow port
17 second negative-pressure passage
17*a* second negative-pressure inflow port
18 base body
18*a* upper end surface
20 ejector
20*a* first attachment surface
20*b* second attachment surface
21 ejector body
22 negative-pressure generating mechanism
23 nozzle unit
24 diffuser unit
25 gap
25*a* communication space
26, 92*b* discharge port
27 internal passage

28 supply passage (positive-pressure supply passage)
28*a* first inflow port
29 negative-pressure communication passage
29*c* first negative-pressure supply port (negative-pressure supply port)
29*d* second negative-pressure supply port (negative-pressure supply port)
30 air-supply communication passage
30*a* air-supply inflow port
30*b* ejector-side air-supply port
31 first discharge communication passage
31*a* first discharge outflow port
31*b* first discharge inflow port
32 second inflow communication passage (inflow communication passage)
32*a* second inflow port (inflow port)
33 second discharge communication passage
33*a* second discharge inflow port
33*b* second discharge outflow port
40, 40', 40", 91*b* switching valve
42*b* lower end surface
44*a* first pilot valve
44*b* second pilot valve
50 spool
51 first piston
52 second piston
63*a* first step portion
65 spring seat shaft
66*a* first spring seat
66*b* second spring seat
67 compression spring (spring member)
68 to-be-pressed portion
68*a* second step portion
69 spring accommodating chamber
69*a*, 69*b* end wall
71 orifice (throttle unit)
72 needle valve (throttle unit)
74 check valve
75 pressure sensor
76 spool moving mechanism unit
77 first inflow communication passage (inflow communication passage)
A first output port (output port)
B second output port (output port)
EA first discharge port
EB second discharge port
L axis
P switching-valve-side air-supply inflow port
P1 first-end-side switching position
P2 second-end-side switching position
P3 first intermediate switching position
P4 second intermediate switching position
P5 neutral switching position

The invention claimed is:

1. An ejector that generates a negative pressure under an action of compressed air, the ejector comprising:

an ejector body in which an internal passage is formed; and a negative-pressure generating mechanism including a nozzle unit that is connected to the internal passage and that ejects compressed air and a diffuser unit that generates a negative pressure by using compressed air ejected by the nozzle unit and that discharges compressed air to outside, wherein the ejector body has a first attachment surface to which a valve body that serves as a body of a switching valve is fixedly attached and a second attachment surface to which a base body that serves as a body of a manifold base is fixedly attached, wherein an inflow port for supplying compressed air to the negative-pressure generating mechanism by being connected to an output port that is formed in the valve body of the switching valve is formed in the first attachment surface of the ejector body, and the inflow port communicates with the nozzle unit through a positive-pressure supply passage that is included in the internal passage in the ejector body, wherein a negative-pressure supply port for outputting a negative pressure, which is generated in the negative-pressure generating mechanism, to outside by being connected to a negative-pressure inflow port that is formed in the base body of the manifold base is formed in the second attachment surface of the ejector body, and the negative-pressure supply port communicates with the diffuser unit through a negative-pressure communication passage that is included in the internal passage in the ejector body, wherein the inflow port of the first attachment surface includes a first inflow port and a second inflow port that are respectively connected to a first output port and a second output port of the output port that are formed in the valve body of the switching valve, wherein one of the first inflow port and the second inflow port communicates with the nozzle unit through the internal passage, and wherein another one of the first inflow port and the second inflow port communicates with the negative-pressure supply port through the internal passage.

2. The ejector according to claim 1, wherein an ejector-side air-supply port for supplying compressed air to the switching valve by being connected to a switching-valve-side air-supply inflow port that is formed in the valve body of the switching valve is formed in the first attachment surface, wherein an air-supply inflow port for receiving compressed air by being connected to an air-supply port that is formed in the base body of the manifold base is formed in the second attachment surface, and wherein the ejector-side air-supply port and the air-supply inflow port communicate with each other through an air-supply communication passage that is included in the internal passage in the ejector body.

3. A vacuum generating device comprising:

the ejector according to claim 2;

the manifold base attached to the second attachment surface of the ejector; and the switching valve attached to the first attachment surface of the ejector, wherein the switching valve includes the valve body having a valve hole that is formed in such a manner as to extend from a first end side to a second end side in an axial direction and a plurality of ports that are formed in such a manner as to communicate with the valve hole, a spool that is accommodated in the valve hole of the valve body in such a manner as to be capable of freely sliding in the axial direction, a first driving unit and a second driving unit that are arranged at two ends of the spool in the axial direction and that move the spool to a second-end-side switching position on the second end side in the axial direction and move the spool to a first-end-side switching position on the first end side in the axial direction, and a spool moving mechanism unit that selectively moves the spool to a first-intermediate switching position and a second-intermediate switching position that are located between the first-end-side switching position and the second-end-side switching position and that are different from each other, wherein the plurality of ports includes the first output port connected to the first inflow port of the ejector, the second output port connected to the second inflow port of the ejector, and the switching-valve-side air-supply inflow port to which compressed air is supplied by being connected to the ejector-side air-supply port formed in the first attachment surface of the ejector, wherein the spool moving mechanism unit moves the spool that has moved to the first-end-side switching position to the first-intermediate switching position when the spool is released from being pressed by the second driving unit and moves the spool that has moved to the second-end-side switching position to the second-intermediate switching position when the spool is released from being pressed by the first driving unit, wherein the first-intermediate switching position is in a communication state in which one of the first output port and the second output port that is in communication with the nozzle unit communicates with the switching-valve-side air-supply inflow port and in which the other ports are closed and do not communicate with each other, and wherein the second-intermediate switching position is in a non-communication state in which all the plurality of ports are closed and do not communicate with each other.

4. The vacuum generating device according to claim 3, wherein the spool includes a spring seat shaft that is coaxial with the spool, wherein the spool moving mechanism unit includes a first spring seat and a second spring seat that are respectively arranged on a first end side and a second end side of the spring seat shaft in the axial direction in such a manner as to be freely movable in the axial direction and includes a compression spring that is provided between the first spring seat and the second spring seat, wherein the spring seat shaft includes a pair of contact portions arranged at the two ends of the spring seat shaft in the axial direction such that the first and second spring seats are brought into contact with the contact portions, and the compression spring is disposed so as to be compressed when the first and second spring seats are in contact with the pair of contact portions, wherein a pair of stopper portions with which the first and second spring seats are brought into contact are provided at two sides of the valve hole of the valve body in the axial direction with the spool moving mechanism unit interposed between the stopper portions, and wherein, when a length between the pair of contact portions in the axial direction is X, a length between the pair of stopper portions in the axial direction is Y, a stroke length of the spool by the first driving unit is S1, and a stroke length of the spool by the second driving unit is S2, relationships of $X<Y$ and $Y-X<S1$, S2 are satisfied.

5. The vacuum generating device according to claim 4, wherein the valve hole has a spring accommodating chamber that extends in the axial direction and in which the spool moving mechanism unit is accommodated, wherein the spring accommodating chamber has a pair of end walls that are formed at two ends of the spring accommodating chamber in the axial direction and each of which extends outward in a radial direction, and wherein one of the pair of end walls includes the stopper portion with which the first spring seat is brought into contact, and another one of the pair of end walls includes the stopper portion with which the second spring seat is brought into contact.

6. The vacuum generating device according to claim 5, wherein the pair of contact portions includes a first step portion that projects outward in the radial direction from the first end of the spring seat shaft in the axial direction and that is capable of coming into contact with the first spring seat and a second step portion that projects outward in the radial direction from the second end of the spring seat shaft in the axial direction and that is capable of coming into contact with the second spring seat, and wherein the spool is switched to the first-intermediate switching position in a state where the first spring seat is in contact with the end wall on a first side of the spring accommodating chamber in the axial direction and the first step portion and where the second spring seat is in contact with the second spring seat and is switched to the second-intermediate switching position in a state where the second spring seat is in contact with the end wall on a second side of the spring accommodating chamber in the axial direction and the second spring seat and where the first spring seat is in contact with the first step portion.

7. The ejector according to claim 1, wherein the negative-pressure supply port includes a first negative-pressure supply port and a second negative-pressure supply port for supplying a negative pressure by being respectively connected to a first negative-pressure inflow port and a second negative-pressure inflow port that are formed in the base body of the manifold base, wherein the first negative-pressure supply port and the second negative-pressure supply port communicate with the diffuser unit through the negative-pressure communication passage included in the internal passage, and wherein the other one of the first inflow port and the second inflow port communicates with the negative-pressure communication passage through an inflow communication passage that is included in the internal passage.

8. The ejector according to claim 7, wherein a throttle unit for controlling a flow rate of air that flows toward the negative-pressure supply port is disposed in the inflow communication passage.

9. The ejector according to claim 7, wherein a check valve that allows a flow of air from the negative-pressure communication passage toward the diffuser unit and limits a flow of air from the diffuser unit toward the negative-pressure communication passage is disposed in the negative-pressure communication passage.

10. The ejector according to claim 1, wherein a discharge port for discharging compressed air discharged by the diffuser unit is disposed downstream from the diffuser unit.

* * * * *